US007445192B2

(12) United States Patent
Gridley et al.

(10) Patent No.: US 7,445,192 B2
(45) Date of Patent: Nov. 4, 2008

(54) SHEAR WALL TEMPLATE

(75) Inventors: Jerry G. Gridley, Grass Valley, CA (US); Jin-Jie Lin, Livermore, CA (US)

(73) Assignee: Simpson Strong-Tie Company, Inc., Pleasanton, CA (US)

( * ) Notice: Subject to any disclaimer, the term of this patent is extended or adjusted under 35 U.S.C. 154(b) by 69 days.

(21) Appl. No.: 10/868,722

(22) Filed: Jun. 14, 2004

(65) Prior Publication Data

US 2005/0284083 A1 Dec. 29, 2005

(51) Int. Cl.
*E04G 17/12* (2006.01)

(52) U.S. Cl. ..... 249/207; 249/91; 52/699

(58) Field of Classification Search ..... 52/295, 52/293.3, 296, 712–714, 699, 702, 715; 248/300, 248/200; 249/209, 205, 34, 91, 93, 207
See application file for complete search history.

(56) References Cited

U.S. PATENT DOCUMENTS

| | | | |
|---|---|---|---|
| 896,330 | A | 8/1908 | Scheelky |
| 1,382,082 | A | 6/1921 | Heltzel |
| 1,924,724 | A | 8/1933 | Olney |
| 2,163,808 | A | 6/1939 | Pithoud |
| 2,289,604 | A | 7/1942 | Van Cott et al. |
| 2,378,850 | A | 6/1945 | Hyre |
| 2,691,293 | A | 10/1954 | Patterson |
| 2,772,560 | A | 12/1956 | Neptune |
| 2,911,702 | A | 10/1959 | Clyncke |
| 3,126,928 | A | 3/1964 | McMillan |
| 3,150,429 | A | 9/1964 | Shaffer |
| 3,163,909 | A | 1/1965 | Williams |
| 3,298,531 | A * | 1/1967 | Wilcke ..... 211/70.6 |
| 3,377,763 | A | 4/1968 | Beckman |
| 3,458,184 | A | 7/1969 | Schlosser |

(Continued)

OTHER PUBLICATIONS

Hardy Frame Installation Manual with 1997 UBC Code Update. Details. Dimensions and How to Do It? Simplified Structural□□Systems. p. 4. Ventura, CA. May 2000.*
"Accssories" Hardy Frames, Inc. Product Catalog. pp. 1-5, 36-37. Hardy Frames, Inc. Ventura, CA. Jan. 2004.*

(Continued)

*Primary Examiner*—Robert Canfield
*Assistant Examiner*—Christine T Cajilig
(74) *Attorney, Agent, or Firm*—Charles R. Cypher; James R. Cypher

(57) ABSTRACT

A connection is provided between a holder and a plurality of anchor bolts by means of a template. The holder is typically a form board for a cementious member such as a foundation. The template is releasably attached to the form board. The template is formed with a central elongated support, and a plurality of pairs of primary and secondary anchor bolt receiving platforms connected to the central elongated support. The pairs of primary and second anchor bolt receiving platforms are spaced along the central elongated support from each other. Each of the primary and secondary anchor bolt receiving platforms has an opening therein for receiving one of the anchor bolts there through, the openings in each pair of primary and secondary anchor bolt receiving platforms being in alignment so as to receive the same one of the anchor bolts. A plurality of fasteners are releasably connected to the plurality of anchor bolts and are supported by the template to releasably attach the anchor bolts to the template, suspending them in the form where wet cement can surround and envelope the lower portions of the anchor bolts.

20 Claims, 18 Drawing Sheets

U.S. PATENT DOCUMENTS

| | | | | | |
|---|---|---|---|---|---|
| 3,469,815 | A | | 9/1969 | Brenneman | |
| 3,490,760 | A | | 1/1970 | Nill | |
| 3,552,734 | A | | 1/1971 | Severino et al. | |
| 3,553,734 | A | | 1/1971 | Aileo | |
| 3,861,104 | A | | 1/1975 | Bower | |
| 3,912,218 | A | | 10/1975 | Lister | |
| 3,960,356 | A | | 6/1976 | Adams | |
| 3,963,210 | A | | 6/1976 | Macklin | |
| 3,964,219 | A | | 6/1976 | Hala | |
| 3,972,168 | A | | 8/1976 | Allen | |
| 4,000,591 | A | | 1/1977 | Courtois | |
| 4,202,149 | A | | 5/1980 | Betrue, Sr. | |
| 4,261,544 | A | | 4/1981 | Addison | |
| 4,340,200 | A | | 7/1982 | Stegmeier | |
| 4,412,407 | A | | 11/1983 | Melfi et al. | |
| 4,524,553 | A | | 6/1985 | Hacker | |
| 4,612,740 | A | | 9/1986 | Yamamoto | |
| 4,614,070 | A | | 9/1986 | Idland | |
| 4,640,063 | A | | 2/1987 | Ayala | |
| 4,641,478 | A | | 2/1987 | Nelson, Jr. | |
| 4,671,483 | A | | 6/1987 | Harbeke | |
| 4,736,554 | A | | 4/1988 | Tyler | |
| 4,790,509 | A | | 12/1988 | Cardwell et al. | |
| 4,932,818 | A | | 6/1990 | Garwood | |
| 5,002,446 | A | | 3/1991 | Anderson | |
| 5,050,364 | A | | 9/1991 | Johnson et al. | |
| 5,060,436 | A | | 10/1991 | Delgado, Jr. | |
| 5,240,224 | A | | 8/1993 | Adams | |
| 5,317,850 | A | | 6/1994 | Colonias et al. | |
| 5,337,534 | A | * | 8/1994 | Nasca | 52/745.21 |
| 5,357,721 | A | | 10/1994 | Alvarez | |
| 5,388,804 | A | | 2/1995 | Cohen et al. | |
| 5,407,182 | A | | 4/1995 | Hartley | |
| 5,513,476 | A | | 5/1996 | Jones | |
| 5,611,179 | A | | 3/1997 | Leek | |
| 5,619,834 | A | | 4/1997 | Chen | |
| 5,670,076 | A | * | 9/1997 | Leek | 249/53 M |
| 5,699,639 | A | | 12/1997 | Fernandez | |
| 5,706,626 | A | | 1/1998 | Mueller | |
| 5,729,950 | A | | 3/1998 | Hardy | |
| 5,836,132 | A | | 11/1998 | Weathersby | |
| 6,018,917 | A | | 2/2000 | Leek | |
| 6,067,769 | A | | 5/2000 | Hardy | |
| 6,073,413 | A | | 6/2000 | Tongiatama | |
| 6,148,583 | A | | 11/2000 | Hardy | |
| 6,158,184 | A | * | 12/2000 | Timmerman et al. | 52/293.3 |
| 6,185,898 | B1 | | 2/2001 | Pratt | |
| 6,212,849 | B1 | | 4/2001 | Pellock | |
| 6,240,695 | B1 | | 6/2001 | Karalic et al. | |
| 6,244,004 | B1 | | 6/2001 | Timmerman, Sr. et al. | |
| 6,298,612 | B1 | | 10/2001 | Adams | |
| 6,389,767 | B1 | | 5/2002 | Lucey et al. | |
| 6,668,508 | B2 | | 12/2003 | Boone et al. | |
| 6,796,099 | B1 | | 9/2004 | Georges et al. | |
| 2002/0002806 | A1 | | 1/2002 | Commins et al. | |
| 2002/0108332 | A1 | | 8/2002 | Timmerman | |
| 2003/0009964 | A1 | | 1/2003 | Trarup et al. | |

OTHER PUBLICATIONS

"TJ-Shear Panel #2050 Specifier's Guide." Jun. 2004. Trus Joist. Boise, ID.

"TJ-Shear Panel Specifier's Guide." Feb. 2003.Trus Joist. Boise, ID.

"TJ-Shear Panel Specifier's Guide." Mar. 2002.Trus Joist. Boise, ID.

Hardy Frame *Installation Manual with 1997 UBC Code Update. Details. Dimensions and How to Do It*! Simplified Structural Systems. Ventura, CA. May 2000.

"Accessories" Hardy Frames, Inc. Products Catalog. pp. 1-5, 36-37. Hardy Frames, Inc. Ventura, CA. Jan. 2004.

Ideen, Vorschläge. "Nagelplatten." *Bauen Mit Holz*. Germany. Mar. 2003. pp. 33-34.

Untitled document. General product information regarding Shear Max Panel retrieved from the internet on Dec. 16, 2004. URL: http://www.shearmax.com/about.htm. Shear Transfer Systems. Hesperia, CA. Copyright 1999.

"Easy Installation." Shear Max Panel installation instructions retrieved from the internet on Dec. 16, 2004. URL: http://www.shearmax.com/e_i.htm. Shear Transfer Systems. Hesperia, CA. All materials copyright 1999.

"Evaluation Report. PFC-5402. STS Prefabricated Lateral-Force Resisting (LFR) Panel System." ICBO Evaluation Service, Inc. Whittier, CA. Jul. 1, 1998. Retrieved from the internet on Dec. 16, 2004. URL: http://www.shearmax.com/t_data.htm.

Chou, Yeuan. "Research Report: RR 25369. General Approval—Shear Transfer Systems STS Prefabricated Lateral Force Resisting (LFR) Panel System." City of Los Angeles. At least as early as Mar. 1, 2000. Retrieved from the internet on Dec. 16, 2004. URL: http://www.shearmax.com/t_data.htm.

"Acceptance Criteria for Prefabricated Wood Shear Panels. AC130." ICBO Evaluation Service, Inc. Whittier, CA. 1997. Retrieved from the internet on Dec. 16, 2004. URL: http://www.shearmax.com/t_data.htm.

Bahlo, P. Letter to Timothy L. Timmerman, II dated Apr. 8, 1999. ICBO Evaluation Service, Inc. Whittier, CA. Retrieved from the internet on Dec. 16, 2004. URL: http://www.shearmax.com/t_data.htm.

Untitled technical data sheets regarding "Optional Top Connection for Double 2×4 Top Plates" and "Top Plate Connector." Retrieved from the internet on Dec. 16, 2004. URL: http://www.shearmax.com/t_data.htm, document located at http://www.shearmax.com/images/ENG-4002.pdf. Shear Transfer Systems. Hesperia, CA. Copyright 1999.

Bahlo, P. Letter to Timothy L. Timmerman, II dated Aug. 25, 1999. ICBO Evaluation Service, Inc. Whittier, CA. Retrieved from the internet on Dec. 16, 2004. URL: http://www.shearmax.com/t_data.htm.

Untitled drawing sheet regarding Shear Max Panel details retrieved from the internet on Dec. 16, 2004. URL: http://www.shearmax.com/t_data.htm, document located at http://www.shearmax.com/images/STS_DETAILS.pdf. Shear Transfer Systems. Hesperia, CA. Copyright 1999.

Untitled technical data sheet regarding "Allowable In-Plane Shear Loads" and "Formulation of Custom Heights" retrieved from the internet on Dec. 16, 2004. URL: http://www.shearmax.com/t_data.htm, document located at http://www.shearmax.com/images/allowable_shear_loads.pdf. Shear Transfer Systems. Hesperia, CA. Copyright 1999.

Bahlo, P. Letter to Timothy L. Timmerman, II dated Oct. 19, 1998. ICBO Evaluation Service, Inc. Whittier, CA. Retrieved from the internet on Dec. 16, 2004. URL: http://www.shearmax.com/t_data.htm.

"Shearmax™ used under UBC Chap. 23 Div. IV Conventional Light-Frame Construction as sec. 2320.11.4 Alternate braced wall panels." Retrieved from the internet on Dec. 16, 2004. URL: http://www.shearmax.com/t_data.htm, document located at http://www.shearmax.com/images/ENG-5001.pdf. Shear Transfer Systems. Hesperia, CA. Copyright 1999.

"Shearmax™ Panel. Installation As Easy As 1 . . . 2 . . . 3." Retrieved from the internet on Dec. 16, 2004. URL: http://www.shearmax.com/t_data.htm. Shear Transfer Systems. Hesperia, CA. Copyright 1999.

Shearmax™ Panel order sheets. Retrieved from the internet on Dec. 16, 2004. URL: http://www.shearmax.com/t_data.htm. Shear Transfer Systems. Hesperia, CA. Copyright 1999.

"AFS Holdown Form Shoes." *Advanced Connector Systems. Connectors for Wood Construction*. Product catalog. p. 34. Advanced Connector Systems. Tempe, AZ. 1997.

"Strong-Wall Shearwall." *Wood Construction Connectors*. Catalog C-2003; p. 31. Simpson Strong-Tie Company, Inc., Dublin, CA 2002.

"Welcome to Z-walls—Photos" Photos 1, 2. Retrieved from the Internet on Nov. 19, 2003. URL: http://www.z-wall.net/photos.html. Zwall. Honolulu, HI. Publication date unknown.

"Template Installation." *Strong-Wall® Shearwall Installation Guide*. p. 2. Simpson Strong-Tie Company, Inc. Dublin, CA May 2002.

"Strong-Wall concrete Templates." Product Information retrieved from the Internet on Jun. 11, 2004. URL: http://www.strongtie.com/strongwall/product_template.html?source=topnav. Simpson Strong-Tie Company, Inc. Dublin, CA.

"Templates: Installation Photos" *Strong-Wall Shearwall Installation Photos*. Retrieved from the Internet on Jun. 11, 2004. URL: http://www.strongtie.com/strongwall/photos/templates.htm. Simpson Strong-Tie Company, Inc. Dublin, CA.

"Strong-Wall™ Shearwall." Technical data sheets. Simpson Strong-Tie Company, Inc. Pleasanton, CA. Jun. 1999.

"ABS Anchor Bolt Stabilizer," "Strapmate Strap Holder," "Anchormate Anchor bolt holders." *Wood Construction Connectors*. Catalog C-2004. Simpson Strong-Tie Company, Inc. Dublin, CA 2003.

* cited by examiner

SHEAR WALL TEMPLATE

BACKGROUND OF THE INVENTION

The present invention relates to setting anchors in a masonry member, and more specifically to suspending a plurality of anchor bolts from a template and then pouring a wet concrete foundation around the anchor bolts that will then set with the anchor bolts embedded and protruding from it.

It is a generally accepted practice in most parts of the United States to anchor the exterior walls of light frame buildings to the foundation with anchor or bolts that are partially embedded in the foundation and protrude form the top surface of the foundation of the building. It is also becoming more common to see interior walls similarly anchored to the foundation.

One common method of forming a concrete foundation with anchor bolts protruding from its top surface at selected locations is to suspend the anchor bolts in the space defined by the foundation's form and then pour the wet concrete around the anchor bolts. Sometimes the bolts can be supported from below or they can be wired to rebar laid into the foundation. It is also common to attach a special hanger or template to the foundation's form or other structure and then suspend the anchor bolts from the special hanger or template.

Simpson Strong-Tie Company, Inc. sells a plastic hanger or support under the trademark AnchorMate® that is used to suspend a single anchor bolt close to the edge of the foundation. The hanger attaches to a single form board. U.S. Pat. No. 5,407,182, granted to Thomas Hartley, also teaches a support for a single anchor bolt that additionally spaces the form boards for a narrow foundation wall.

Supports for suspending a single anchor bolt work well where the spacing between the bolts is not critical as is the typical case when anchoring the sill plate of a stud-framed wall to the foundation. However, when a plurality of anchor bolts need to be placed in the foundation in close proximity to together receive and anchor a single structural element such as a large post or prefabricated shear wall, it is generally recognized that a single template or hanger should be used to locate the bolts with respect to each other.

One such template for positioning a plurality of anchor bolts is taught by U.S. Pat. No. 3,458,184, granted to Francis G. Schlosser. This invention taught a template that positioned four anchor bolts in close proximity for anchoring lighting and traffic poles. As noted in U.S. Pat. No. 3,458,184, not only is important that the bolts protrude from the foundation at specific distances and orientations with respect to each other, but that they also be set in true plumb. If one of the bolts is skewed with respect to the others, even if protrudes from the foundation at the proper location, it may not be possible to fit the selected structural element to be anchored over all the bolts.

U.S. Pat. No. 3,458,184 teaches forming the template from folded cardboard. Folding and interlocking portions of the template together provide it with rigidity. According to the patent, the templates can be delivered to the construction site unfolded, set-up on site, used, and then restored to their flat positions for easy transport.

In comparison, the present invention is made from a rigid material such as sheet steel and is designed with special reinforcements in selected areas so that it can maintain its structural integrity despite being subjected to the rigors of being used on a construction site, so that it can be reused over and over again.

SUMMARY OF THE INVENTION

It is an object of the present invention to provide a reusable template for a plurality of anchor bolts that are to be embedded in a masonry foundation, the template, itself, not becoming a permanent part of the foundation.

It is an object of the present invention to provide a reusable template for a plurality of anchor bolts that accurately positions the anchor bolts with respect to each other.

It is a further object of the present invention to provide a reusable template for a plurality of anchor bolts that maintains the bolts a selected distance from the edge of the form when the template of the present invention is located at the edge of the form.

It is a further object of the present invention to provide a reusable template for a plurality of anchor bolts that holds the anchor bolts in a selected vertical alignment while the wet concrete is being poured around the bolts.

It is a further object of the present invention to provide a design for a reusable template for a plurality of anchor bolts that is easily adapted by the manufacturer to accommodate either the attachment to a foundation form where there is a horizontal surface close to the upper ends of the anchor bolts or the attachment to a foundation form where there is no horizontal surface close to the upper ends of the anchor bolts.

It is a further object of the present invention to provide a reusable template for a plurality of anchor bolts that can be attached to a horizontal surface of a concrete form either where the horizontal surface of the concrete form is approximately level with the ultimate level of the concrete as where the bolts are set to anchor exterior walls, or where the horizontal surface for attaching the template lies a selected distance above the ultimate level of the concrete as where the bolts are set within the interior of the concrete form, that is away from the edges of the form.

It is a further object of the present invention to provide a template for a plurality of anchor bolts that provides protection to some of the threaded portions of the anchor bolts above the ultimate level of the concrete from coming into contact with wet concrete.

It is a further object of the present invention to provide a template for a plurality of anchor bolts that is resistant to deformation as when the template may be pried from the concrete or the form with a lever.

It is a further object of the present invention to provide openings in the template for receiving the anchor bolts that allow easy insertion of the anchor bolts into the openings, and for the removal of the template from the anchor bolts once the concrete has set around the anchor bolts.

It is a further object of the present invention to provide for a template that can be made from sheet steel on an automated progressive die from a substantially rectangular blank so as to conserve material, so that the template is economical to produce.

These objects are achieved in part by forming the template of the present invention with a central elongated support that is resistant to bending and can hold the other members of the template.

These objects are achieved in part by providing the central elongated support with a central strengthening flange that is connected to the support and stabilizes the support against deformation.

These objects are achieved in part by providing the template of the present invention with a plurality of discrete primary anchor bolt receiving platforms that are connected to the central elongated support. The use of discrete anchor bolt receiving platforms conserves material.

These objects are achieved in part by providing the template of the present invention with a plurality of primary anchor bolt receiving platforms that are connected to the central elongated support and the central strengthening flange to make the template more rigid.

These objects are achieved in part by providing the template of the present invention with a plurality of secondary anchor bolt receiving platforms that are connected to the central elongated support, each secondary anchor bolt receiving platform working in tandem with a corresponding primary anchor bolt receiving platform. By holding each bolt with two anchor receiving platforms, the bolt is braced from being knocked out of vertical alignment.

These objects are achieved in part by providing the template of the present invention with a one or more stabilizing flanges. In the preferred embodiment the stabilizing flanges stabilize the template when the template is attached to the top surface of a form board whose top surface is roughly level with the top surface of the cementious member. In the preferred embodiment, the stabilizing flanges also stabilize the template when the top surface of the support structure is a selected distance above the top surface of the cementious member, that distance being approximately 1.5 inches. In the preferred embodiment, the stabilizing flanges also stabilize the template when the template is attached to the vertical face of the form.

These objects are achieved in part by providing the primary bolt receiving platforms with one or more platform extensions, which further strengthen the template.

These objects are achieved in part by providing either the primary or secondary bolt receiving platforms with one or more platform strengthening flanges, that act as spacers between the primary and secondary anchor bolt receiving platforms and strengthen the anchor bolt receiving platforms to which they are attached.

These objects are achieved in part by providing the template with one ore more attachment flanges.

These objects are achieved in part by providing the primary and secondary anchor bolt receiving platforms with drawn openings for receiving the anchor bolt.

DETAILED DESCRIPTION OF THE PREFERRED EMBODIMENT

Figure 1:
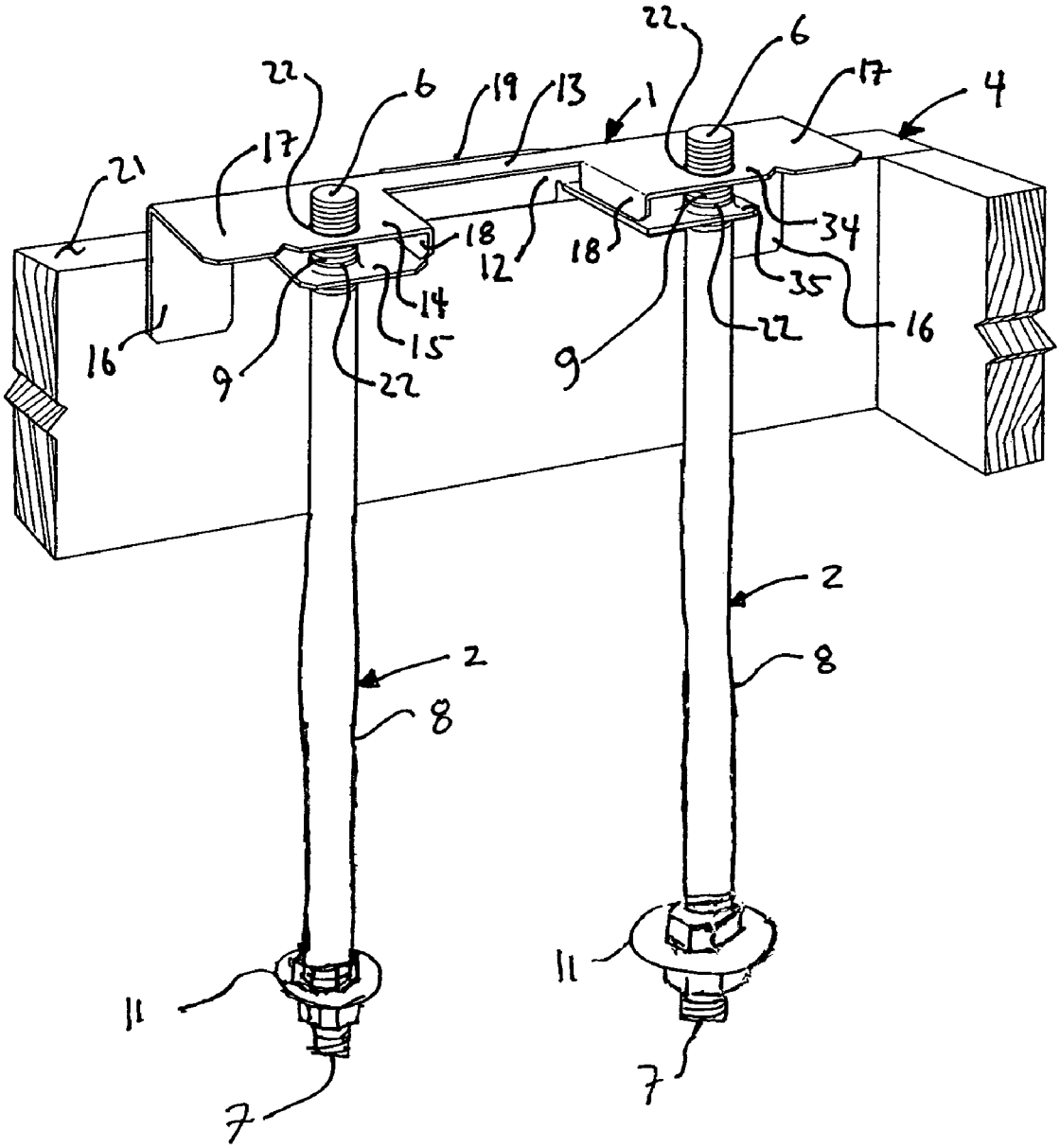
FIG. 1 is a perspective view of an anchor bolt template of the present invention attached directly to the form for the masonry foundation.
Figure 3:
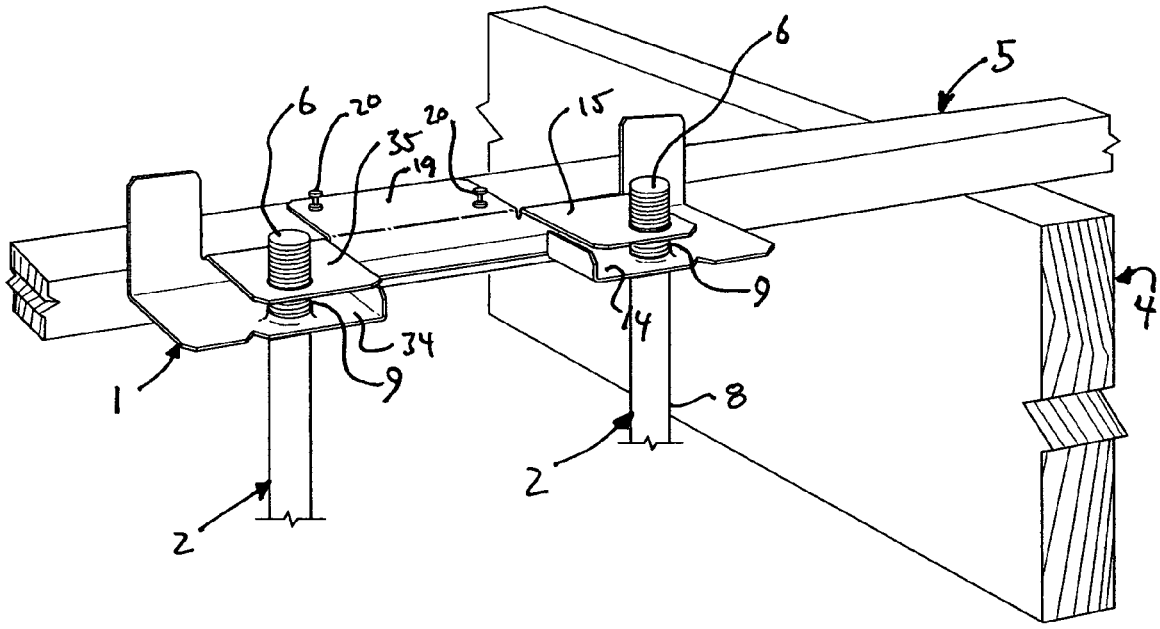
FIG. 3 is a perspective view of an anchor bolt template of the present invention attached to a support that rests on top of the form for the masonry foundation, as would typically occur if the anchor bolts were to be set within the interior of the masonry foundation.
Figure 4:
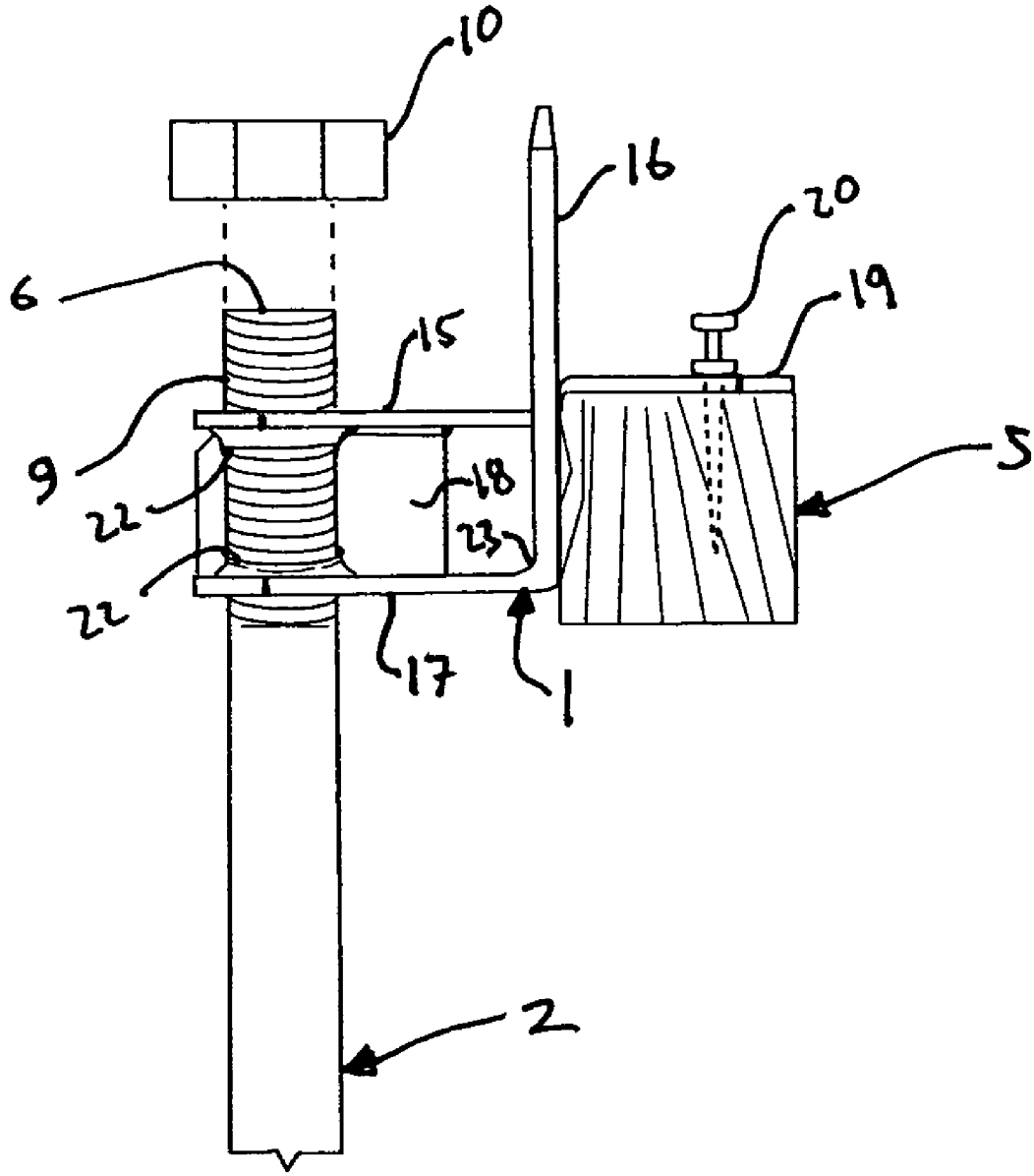
FIG. 4 is a side view of an anchor bolt template of the present invention attached to a support that rests on top of an exterior form board for the foundation. A nut is shown positioned over the anchor bolt to which it will be attached.

The present invention provide a template 1 for receiving and supporting a plurality of anchor bolts 2 that are to be partially embedded within a cementious member 3. The template 1 is used where the wet cement is to be poured around the anchor bolts 2 that are held in place. As shown in FIG. 1, the template can be attached to the form 4 that defines the edge of the concrete member 3, or, as is shown in FIG. 3, the template can be attached to a support 5 separate from the form 4.

Figure 2:
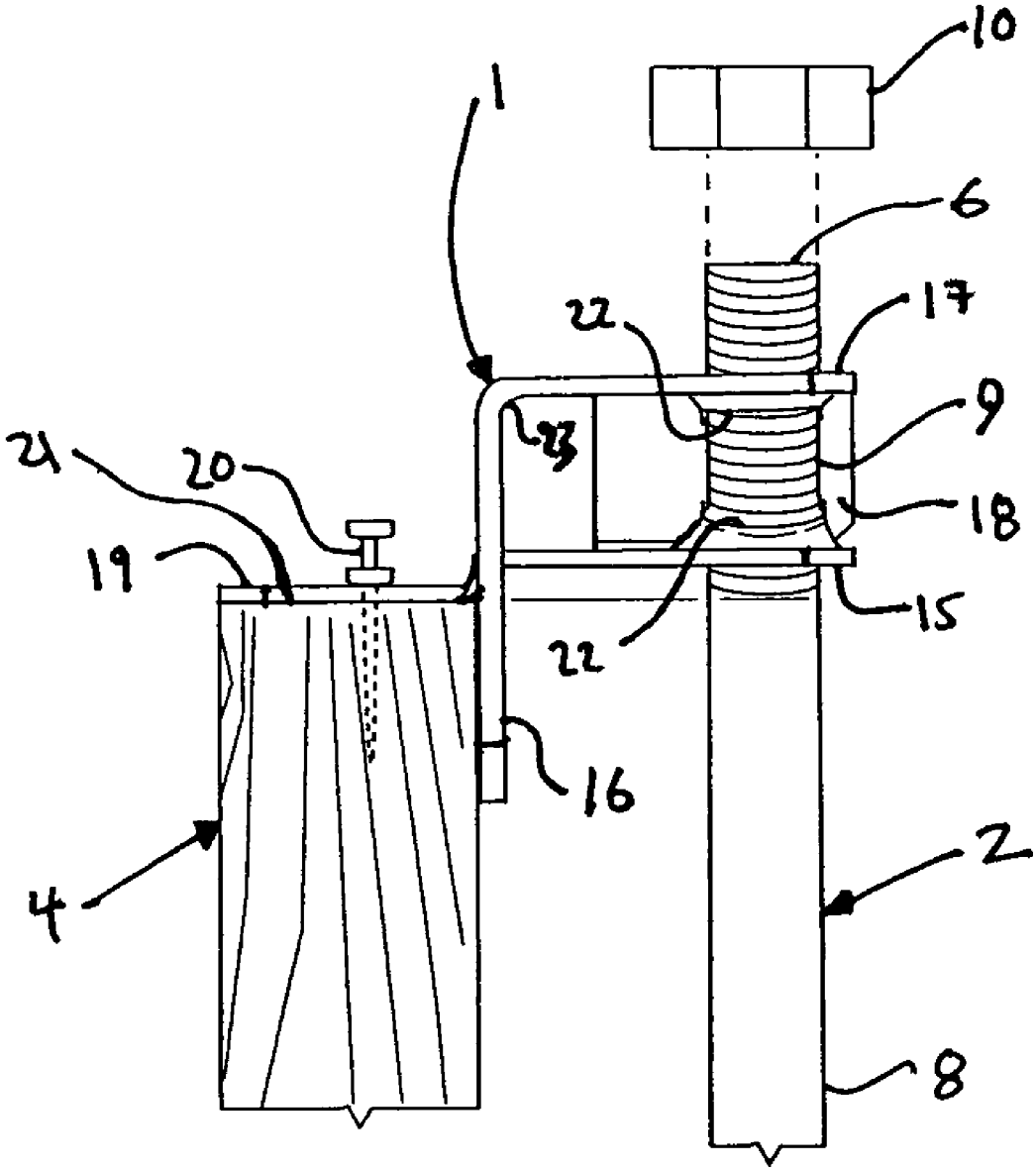
FIG. 2 is a side view of an anchor bolt template of the present invention attached to an exterior form board for the foundation. A nut is shown positioned over the anchor bolt to which it will be attached.
Figure 37:
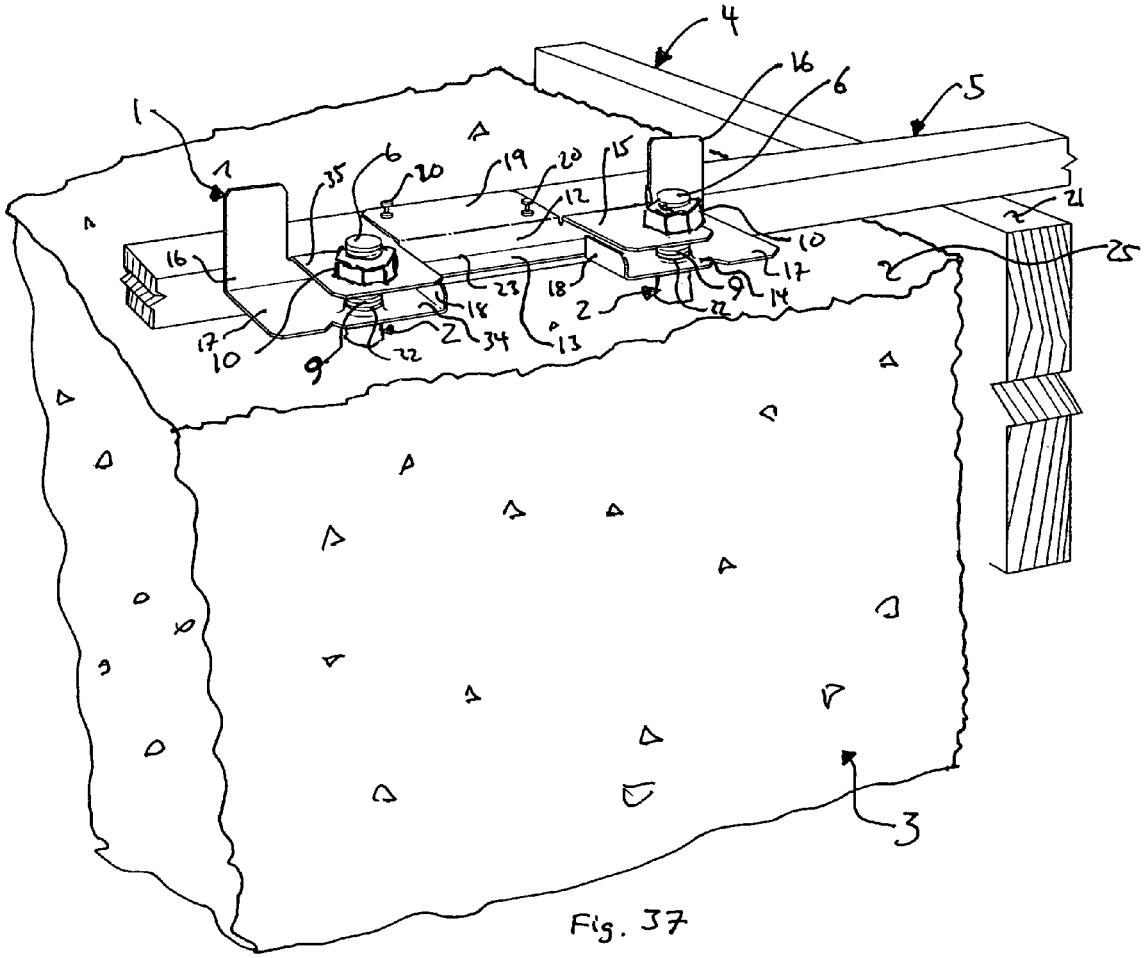
FIG. 37 is a view similar to FIG. 1 showing the template supporting the anchor bolts after the cementious member has been poured.
Figure 38:
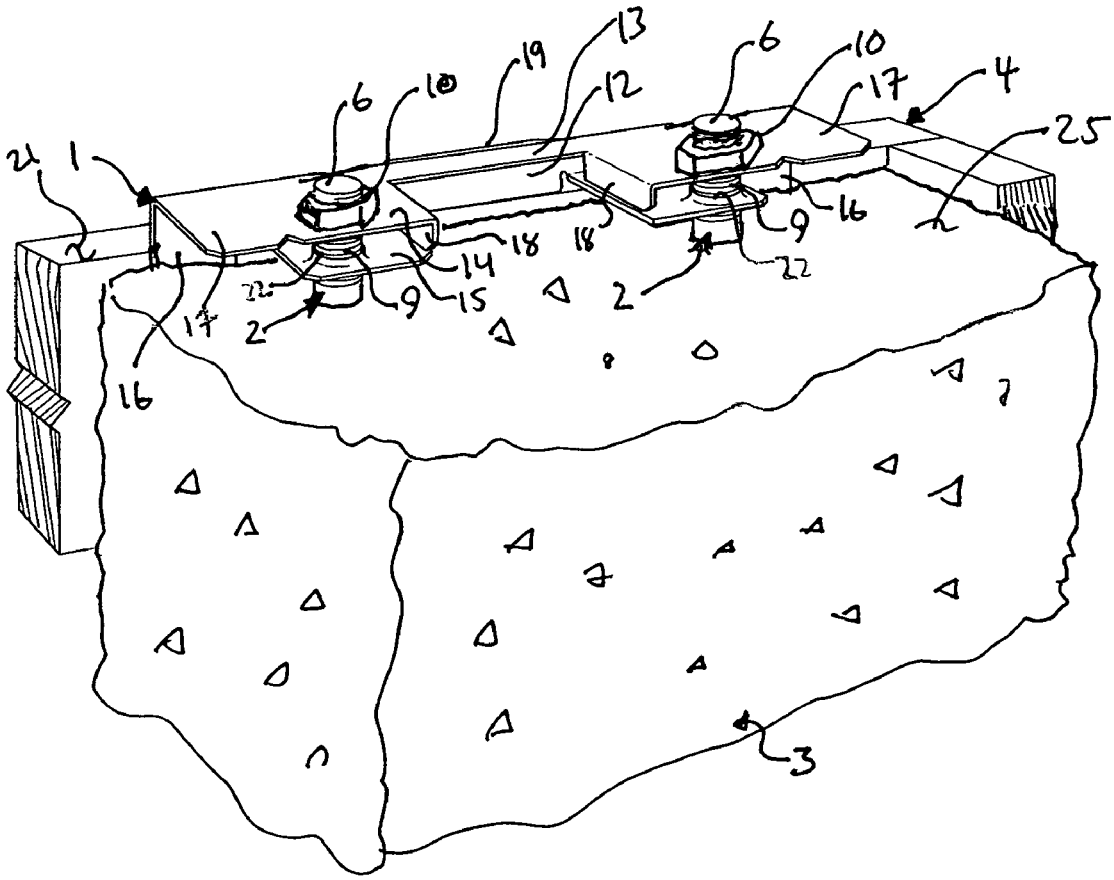
FIG. 38 is a view similar to FIG. 3 showing the template supporting the anchor bolts after the cementious member has been poured.

As shown in FIG. 1, the anchor bolt 2 is provided with an upper end 6, a lower end 7 and a shank 8. The upper end 6 of the anchor bolt 2 is received by the template 1 with the upper end 6 of the anchor bolt 2 protruding through and above the template 1. In the preferred embodiment, the upper end 6 of the anchor bolt 2 and the upper portion of the shank 8 of the anchor bolt 2 is provided with a threaded portion 9 to receive a standard nut 10, which is shown in FIGS. 2 and 37. In the preferred embodiment, a washer 11 is placed on the anchor bolt 2 near its lower end 7 to provide anchor bolt 2 with increased resistance to pull-out forces.

As is shown in FIG. 1, the template 1 of the present invention is formed with a central elongated support 12 that is resistant to bending and can hold the other members of the template 1. To increase the strength of the central elongated support 12 and the template 1, in the preferred embodiment, the central elongated support 12 is provided with a central strengthening flange 13 that is connected to the support and stabilizes the central elongated support 12 against deformation.

Figure 34:
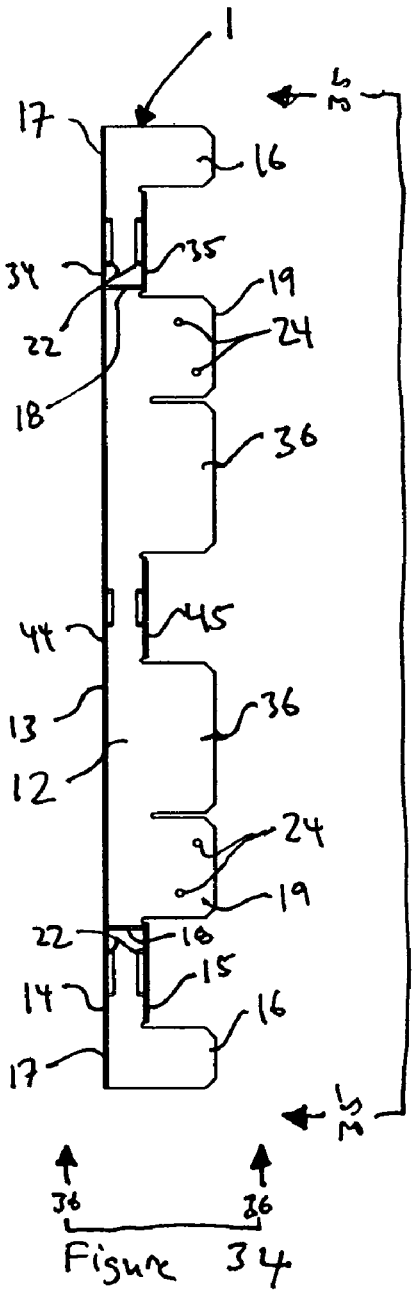
FIG. 34 is a front view of an anchor bolt template of the present invention that is cut from the same blank as the anchor bolt template shown in FIG. 31. The anchor bolt template shown in FIG. 34 is suitable for installations where the template is nailed to a vertical surface, such as the exterior wall of a very tall form where the concrete will not rise to the top level of the form.
Figure 35:
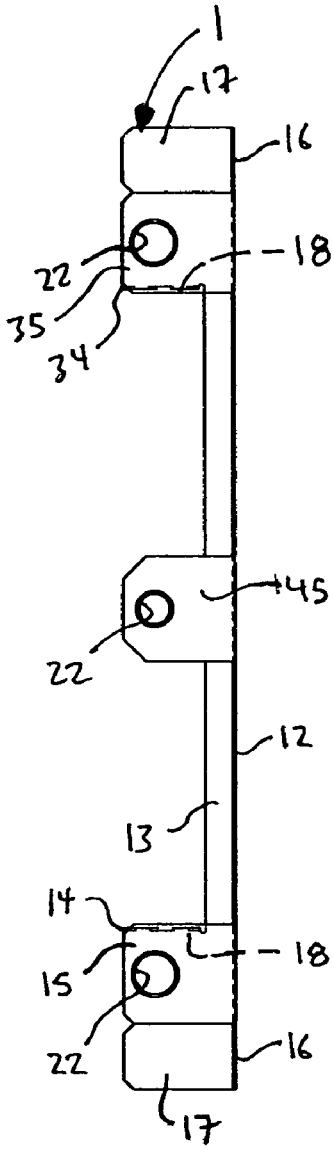
FIG. 35 is plan view of the anchor bolt template of FIG. 34 taken along lines 35-35 of FIG. 34.
Figure 36:
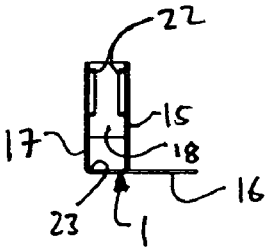
FIG. 36 is an end view of the anchor bolt template of FIG. 34 taken along lines 36-36 of FIG. 34.

As is also shown in FIG. 1, in the preferred embodiment of the invention, the template 1 is provided with a plurality of primary anchor bolt receiving platforms 14 and 34 and a plurality of secondary anchor bolt receiving platforms 15 and 35, both of which are connected to the central elongated support 12. As is shown in FIGS. 34, 35 and 36, the template 1 can be made with additional primary and secondary anchor bolt receiving platforms 44 and 45. Each of the secondary anchor bolt receiving platforms 15, 35 and 45 works in tandem with a corresponding primary anchor bolt receiving platform 14, 34 and 44.

Figure 25:
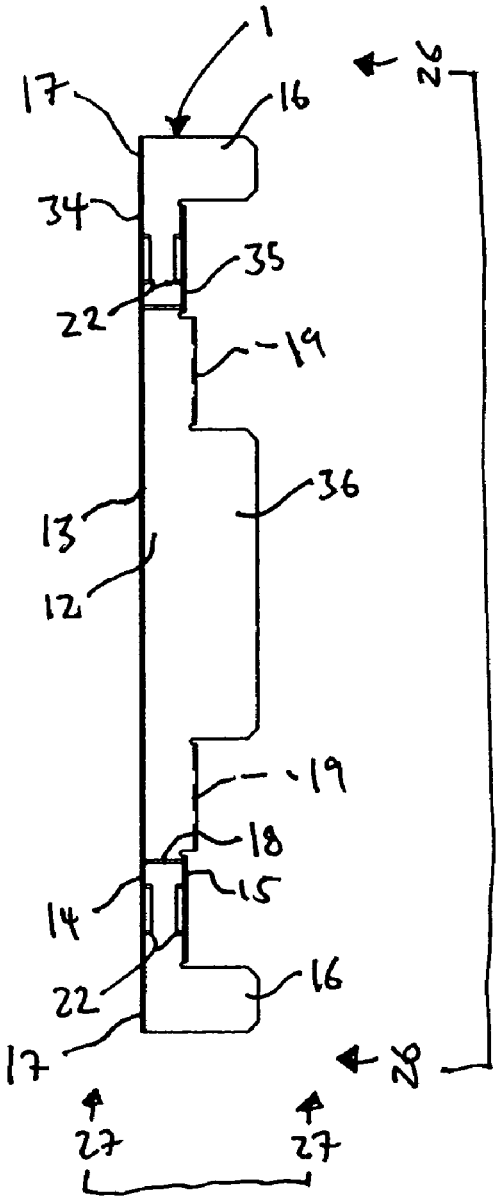
FIG. 25 is a front view of an anchor bolt template of the present invention.
Figure 26:
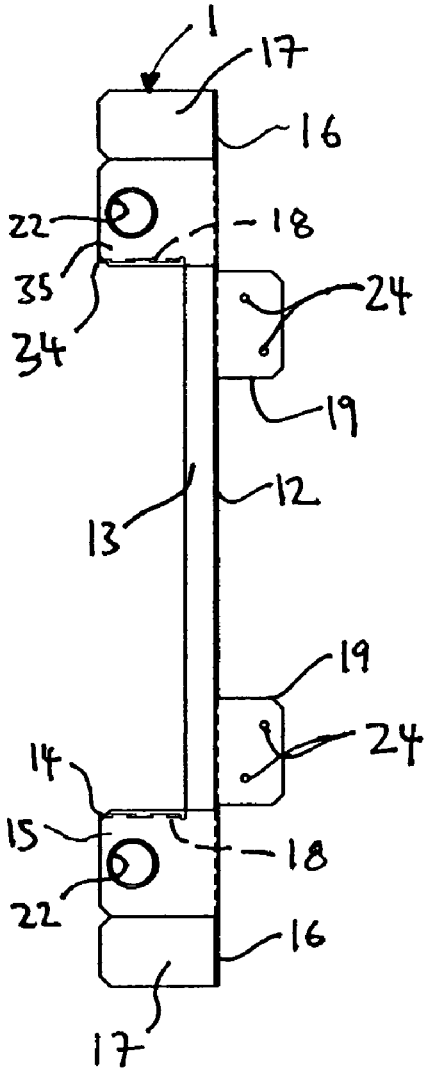
FIG. 26 is plan view of the anchor bolt template of FIG. 25 taken along lines 26-26 of FIG. 25.
Figure 27:
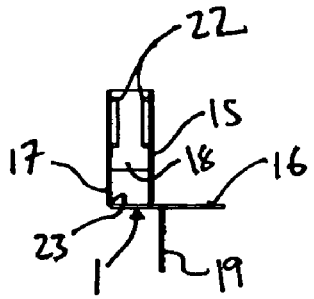
FIG. 27 is an end view of the anchor bolt template of FIG. 25 taken along lines 27-27 of FIG. 25.
Figure 28:
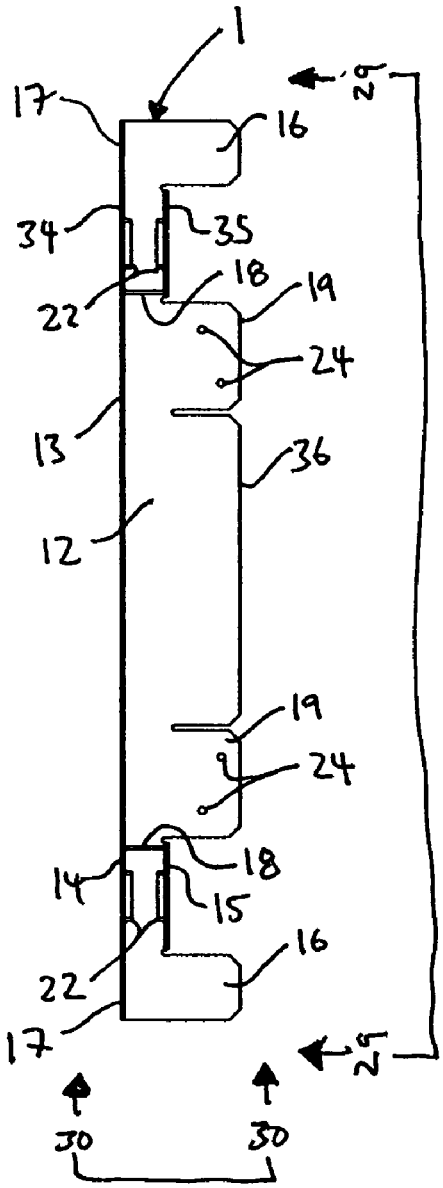
FIG. 28 is a front view of an anchor bolt template of the present invention that is cut from the same blank as the anchor bolt template shown in FIG. 25. The anchor bolt template shown in FIG. 28 is suitable for installations where the template is nailed to a vertical surface, such as the exterior wall of a very tall form where the concrete will not rise to the top level of the form.
Figure 29:
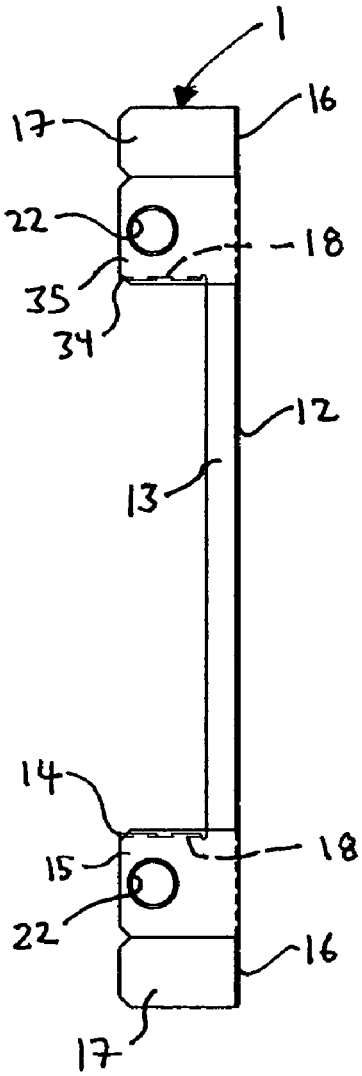
FIG. 29 is plan view of the anchor bolt template of FIG. 28 taken along lines 29-29 of FIG. 28.
Figure 30:
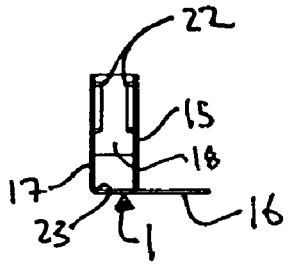
FIG. 30 is an end view of the anchor bolt template of FIG. 28 taken along lines 30-30 of FIG. 28.

As is also shown in FIG. 1, in the preferred embodiment of the present invention the template 1 is formed with one or more stabilizing flanges 16. In the preferred form of the invention, the stabilizing flanges 16 are connected to the central elongated support 12. As is shown in FIG. 1, stabilizing flanges 16 are preferably located at the ends of the template. As is shown in FIGS. 25, 26 and 27, the template can be made with additional stabilizing flanges 36 placed between the ends of the template 1.

As is also shown in FIG. 1, in the preferred form of the invention, the primary anchor bolt receiving platforms 14 and 34 are also formed with one or more platform extensions 17, and also with one or more platform strengthening flanges 18.

As shown in FIG. 2, to attach the template to the exterior form 4, the template 1 is provided an attachment flange 19. In the preferred embodiment, double-headed nails 20 are used to attach the attachment flange 19 to the exterior form 4 which is made form wood that is approximately 1½ inches wide.

As is shown in FIG. 1, the attachment flange 19 interfaces with and is connected to the top surface 21 of the form 4.

To allow the template 1 to be easily removed from the anchor bolts 2 once the concrete of the cementious member 3 has set, the primary and secondary anchor bolt receiving platforms 14 and 15 are provided with drawn openings 22 for receiving the anchor bolts 2.

In the present invention of a connection between a holder, which can be a form board 4 or a support 5 separate from the form for the cementious member 3, and a plurality of anchor bolts 2, the template 1 works in combination with removable fasteners, typically nuts 10, to suspend the anchor bolts 2 in the form where the concrete will be poured. The template 1 is releasably attached to the form board 4, or support 5, by double-headed fasteners 20 which are commonly used for building forms 4 for making concrete or cementious structures 3.

Figure 31:
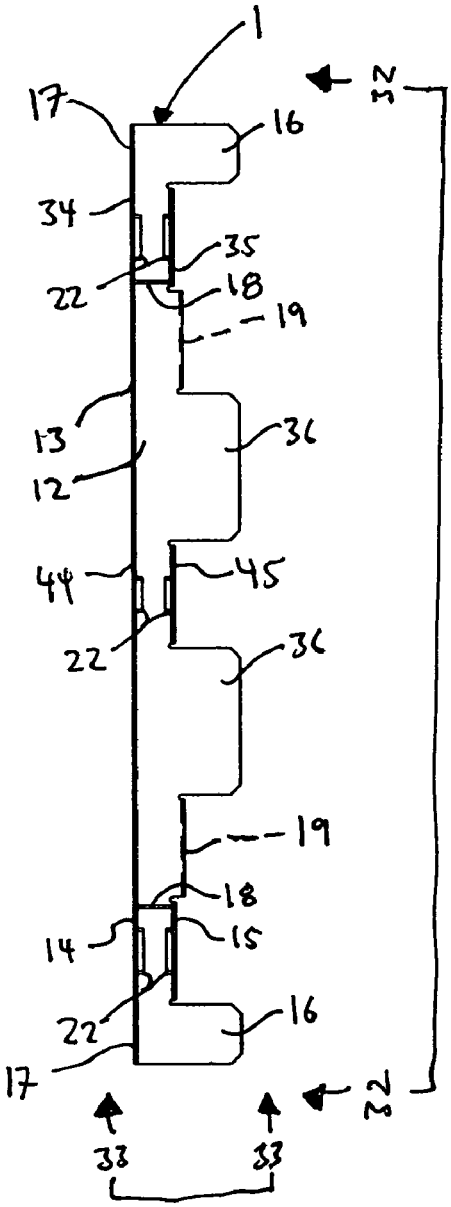
FIG. 31 is a front view of an anchor bolt template of the present invention.
Figure 32:
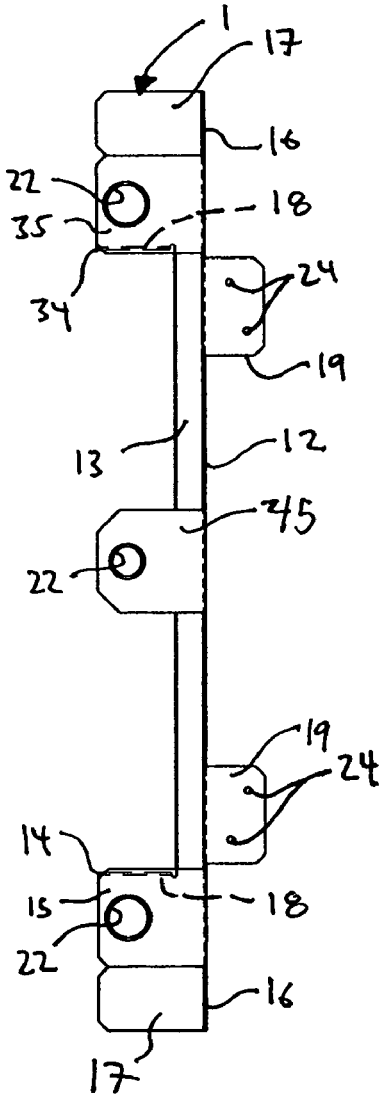
FIG. 32 is plan view of the anchor bolt template of FIG. 31 taken along lines 32-32 of FIG. 31.
Figure 33:
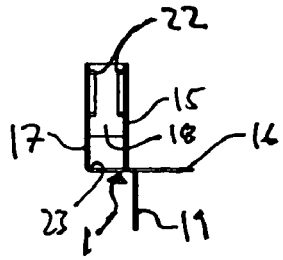
FIG. 33 is an end view of the anchor bolt template of FIG. 31 taken along lines 33-33 of FIG. 31.

As is shown in FIGS. 31, 32 and 33, the template 1 is formed with a central elongated support 12 and a plurality of pairs of primary and secondary anchor bolt receiving platforms 14 and 1 5, 34 and 35, and 44 and 45, which are connected to the central elongated support 12. The pairs of primary and second anchor bolt receiving platforms 14 and 15, 34 and 35, and 44 and 45 are spaced along the central elongated support 12 from each other.

Each of the primary and secondary anchor bolt receiving platforms 14 and 15, 34 and 35, and 44 and 45 have an opening 22 therein for receiving one of the anchor bolts 2 there through. The openings 22 in each pair of primary and secondary anchor bolt receiving platforms 14 and 15, 34 and 35, and 44 and 45 are in alignment so as to receive the same one of the anchor bolts 2.

The anchor bolts 2 are releasably suspended from the template 1 by a plurality of fasteners, typically nuts 10, releasably connected to the plurality of anchor bolts 2. In using the template 1, the anchor bolts 2 are inserted into the anchor bolt receiving openings 22, the nuts 10 are attached to the upper ends 6 of the anchor bolts 2, and then the template 1 is attached to the form board 4 or the separate support structure 5. The nuts 10 are releasably connected to the plurality of anchor bolts and are supported by the template 1 to releasably attach the anchor bolts 2 to the template 1, suspending them in the form where wet cement can surround and envelope the lower portions of the anchor bolts 2.

In the preferred embodiments of the invention, extensions 17 are connected the primary anchor bolt receiving platforms 34 and 44 at the ends of the central elongated support 12. The extensions are substantially planar members aligned with the primary anchor bolt receiving members 34 and 44 to which they are connected, providing them with additional strength, and providing additional protection to sections of the threads 9 of the anchor bolts 2 from concrete that might be spilled on them.

In the preferred embodiment of the present invention, a central strengthening flange 13 is connected to the central elongated support 12 and is disposed at a 90 degree angle to the central elongated flange 12 to provide the template 1 with columnar strength. Also in the preferred embodiment, and as is shown in FIGS. 1, 3, 5, 6, 22, 25, 31 and 34, the central strengthening flange 13 is connected to and extends between the primary anchor bolt receiving members 14, 34 and 44, providing the primary anchor bolt receiving platforms 14, 34 and 44 with additional rigidity.

Also in the preferred embodiment, and as is shown in FIGS. 1 and 3, a plurality of strengthening flanges 18 are connected to the primary anchor bolt receiving platforms 14 and 34. The strengthening flanges could instead be connected to the secondary anchor bolt receiving platforms 15 and 35. The strengthening flanges 18 could also be connected to both the primary and secondary anchor bolt receiving platforms 14 and 34 and 15 and 35. The strengthening flanges provide additional rigidity to the anchor bolt receiving platforms to which they are connected.

In the preferred embodiment, and as is shown in FIGS. 1 and 3, the strengthening flanges 18 are disposed at an angle to the primary and secondary anchor bolt receiving platforms 14 and 34 and 15 and 35, preferably that angle is 90 degrees. Also in the preferred embodiment the strengthening flanges 18 substantially extend the distance between the corresponding primary and secondary anchor bolt receiving platforms 14 and 15 and 34 and 35. In this way, if the user tries to pry the template 1 from the anchor bolts 2 after the cementious member 3 has set by inserting a lever under and trying to lift one of the primary or secondary anchor bolt receiving platforms, 14, 15, 34 or 35, the strengthening flange 18 will bear against the corresponding anchor bolt receiving platform of the pair and act as a spacing flange making sure that template 1 lifts as a unit rather than having the anchor bolt receiving flange against which the lever is acting just bend out of position.

In the preferred embodiment of the invention, when the template 1 is attached to an external form board 4 as shown in FIG. 1, and the top surface 21 of the form 4 will be used as the approximate top surface 25 of the cementious member 3, the attachment flange 19 connected to the central elongated support 12 is disposed at a 90 degree angle to the central elongated support 12, the attachment flange 19 interfacing with top surface 21 of the form board 4.

As is best shown in FIGS. 1 and 2, in the preferred embodiment of the template 1, when the template is suspended with the attachment flange 19 attached to the top surface 21 of the form board 4, the attachment flange 19 is disposed parallel to the secondary anchor bolt receiving platforms 15 and 35, and the secondary anchor bolt receiving platforms 15 and 35 are disposed so as to lie above both the top surface 21 of the form board 4 and the attachment flange 19. In this manner there will be space between the top surface 25 of the cementious member 3 and the secondary anchor bolt receiving platforms 15 and 35 which allows the user to finish the concrete under the template 1.

As is shown in FIGS. 5, 6, 14, 20, 26, and 32, the template can be made with a plurality of attachment flanges 19 disposed at a 90 degree angle to the central elongated support 12.

Figure 10:
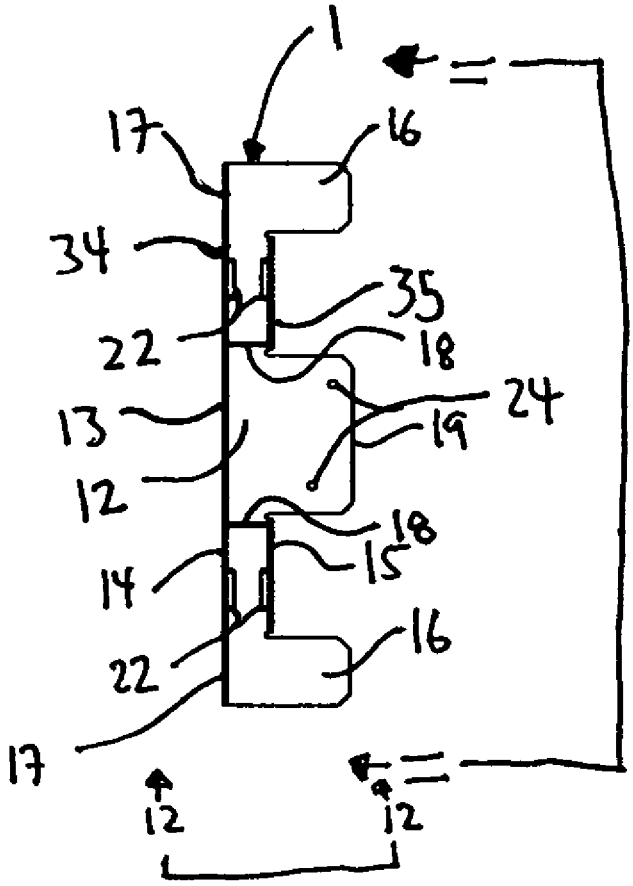
FIG. 10 is a front view of an anchor bolt template of the present invention that is cut from the same blank as the anchor bolt template shown in FIG. 7. The anchor bolt template shown in FIG. 10 is suitable for installations where the template is nailed to a vertical surface, such as the exterior wall of a very tall form where the concrete will not rise to the top level of the form.
Figure 11:
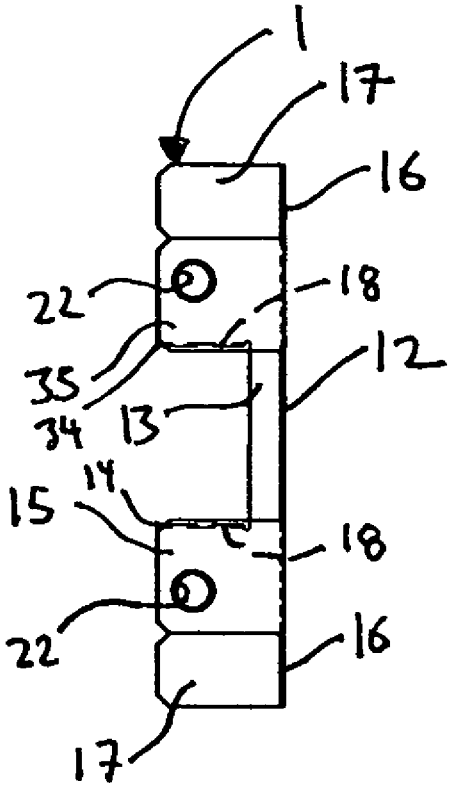
FIG. 11 is plan view of the anchor bolt template of FIG. 10 taken along lines 11-11 of FIG. 10.
Figure 12:
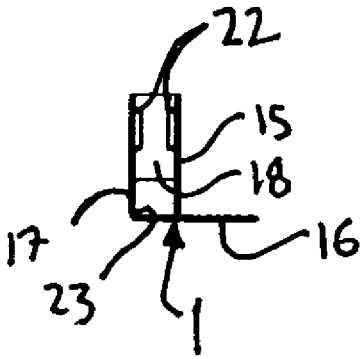
FIG. 12 is an end view of the anchor bolt template of FIG. 10 taken along lines 12-12 of FIG. 10.
Figure 13:
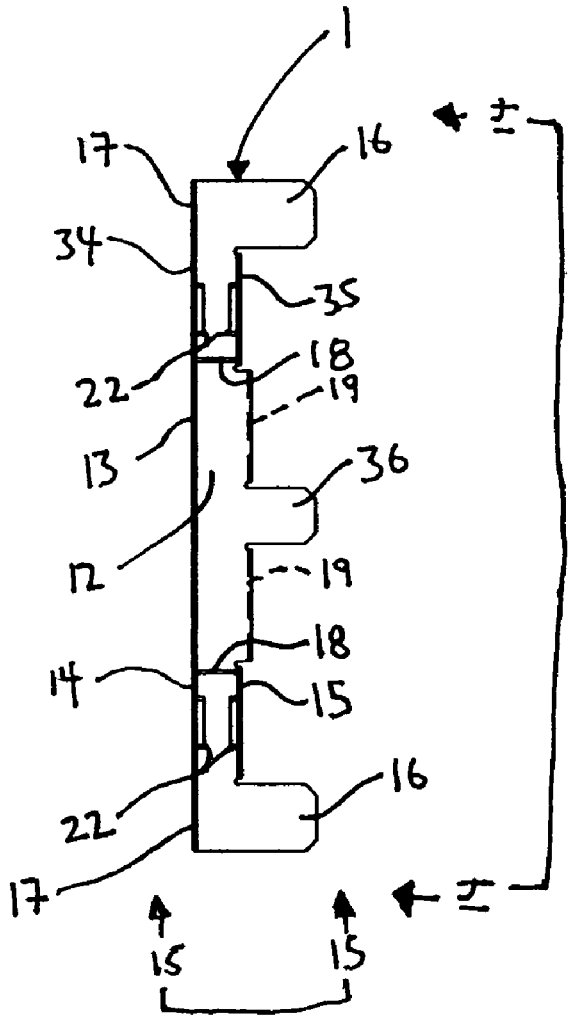
FIG. 13 is a front view of an anchor bolt template of the present invention.
Figure 14:
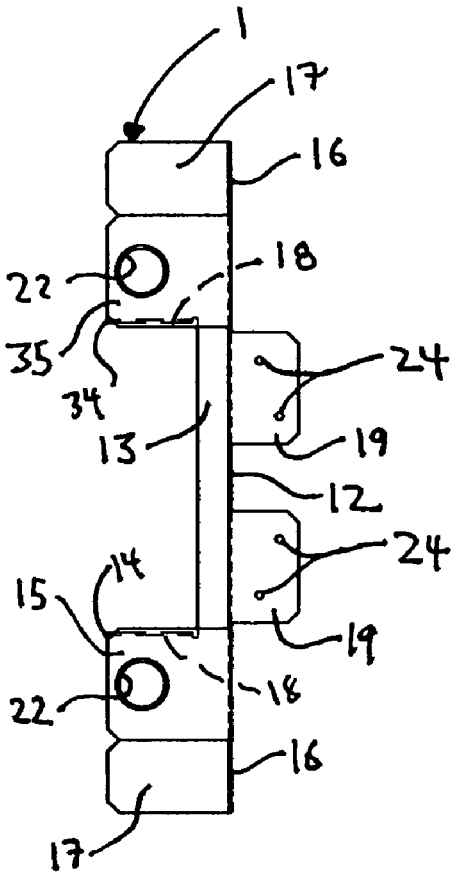
FIG. 14 is plan view of the anchor bolt template of FIG. 13 taken along lines 14-14 of FIG. 13.
Figure 15:
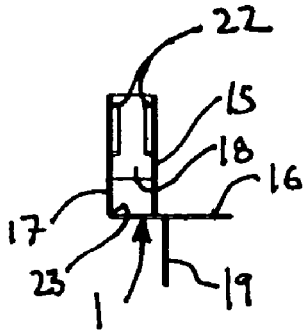
FIG. 15 is an end view of the anchor bolt template of FIG. 13 taken along lines 15-15 of FIG. 13.
Figure 16:
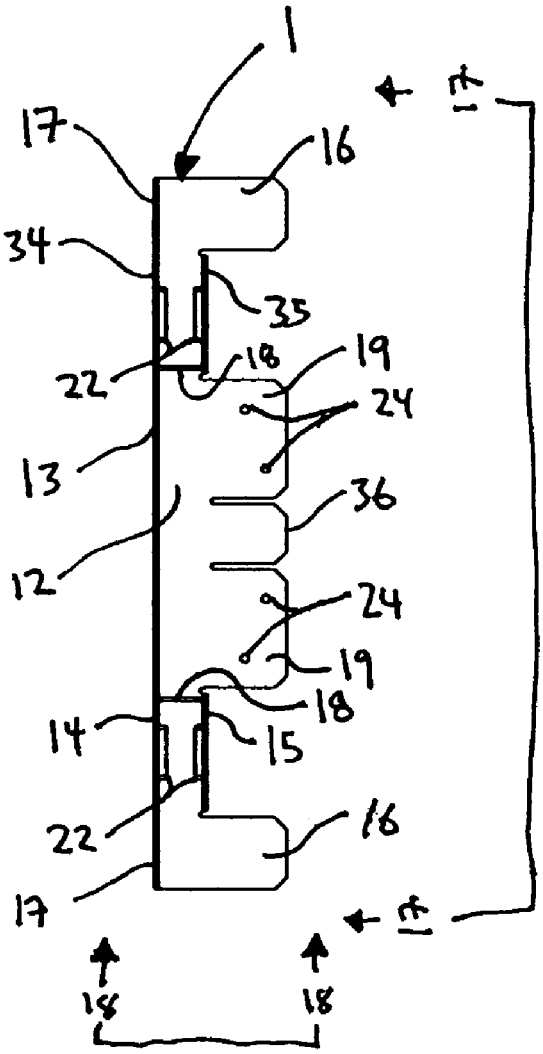
FIG. 16 is a front view of an anchor bolt template of the present invention that is cut from the same blank as the anchor bolt template shown in FIG. 13. The anchor bolt template shown in FIG. 16 is suitable for installations where the template is nailed to a vertical surface, such as the exterior wall of a very tall form where the concrete will not rise to the top level of the form.
Figure 17:
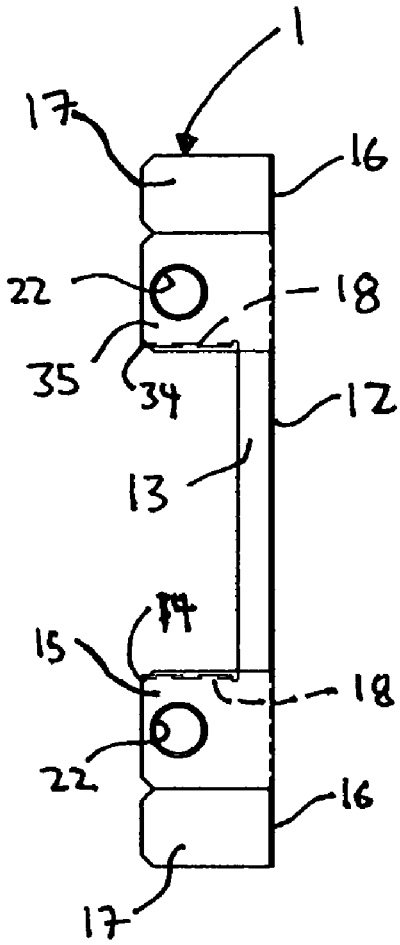
FIG. 17 is plan view of the anchor bolt template of FIG. 16 taken along lines 17-17 of FIG. 16.
Figure 18:
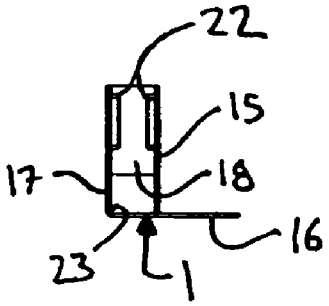
FIG. 18 is an end view of the anchor bolt template of FIG. 16 taken along lines 18-18 of FIG. 16.
Figure 19:
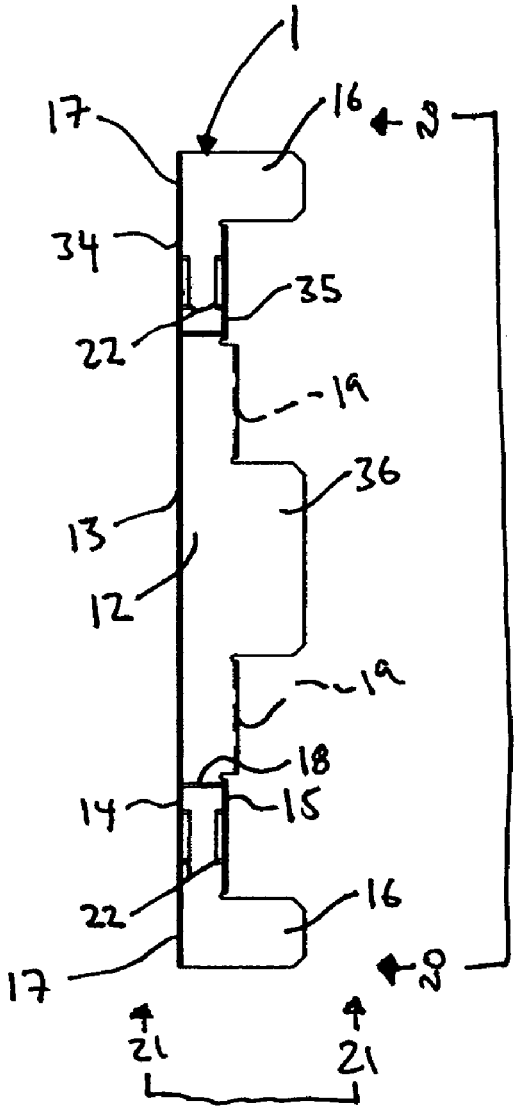
FIG. 19 is a front view of an anchor bolt template of the present invention.
Figure 20:
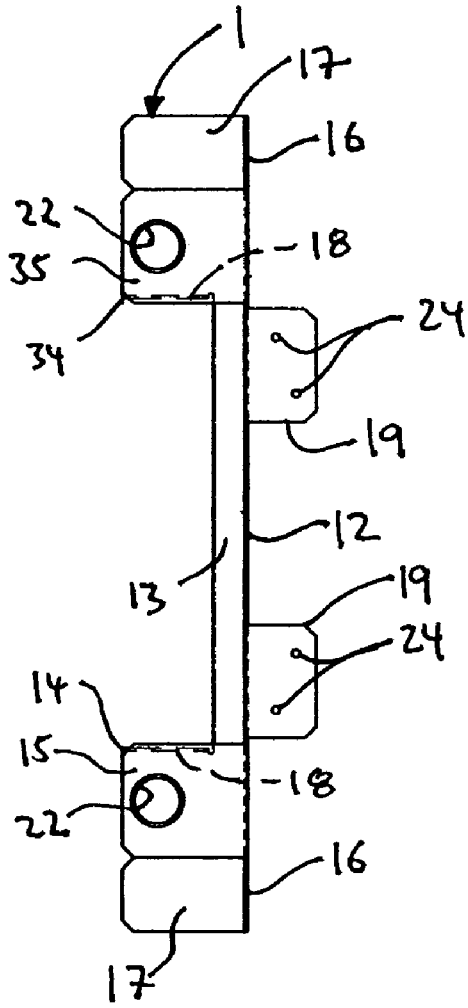
FIG. 20 is plan view of the anchor bolt template of FIG. 19 taken along lines 20-20 of FIG. 19.
Figure 21:
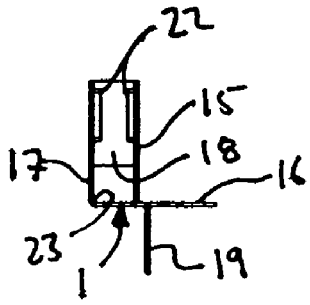
FIG. 21 is an end view of the anchor bolt template of FIG. 19 taken along lines 21-21 of FIG. 19.
Figure 22:
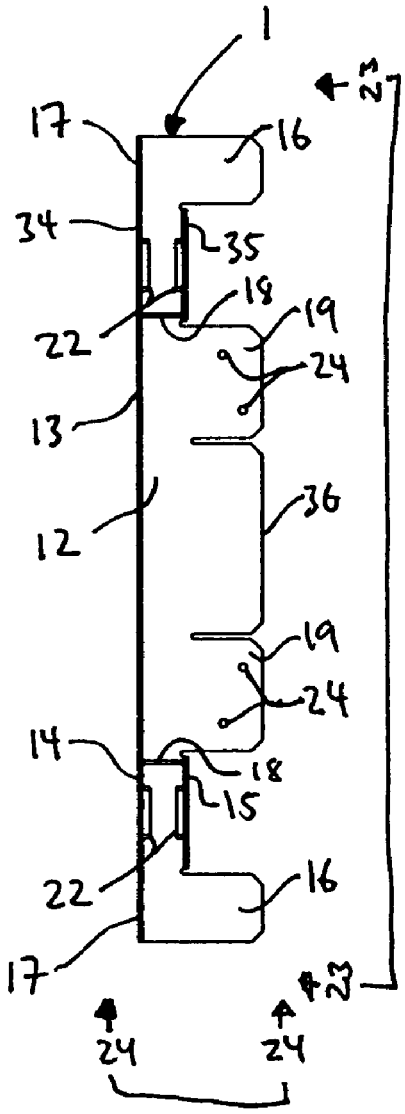
FIG. 22 is a front view of an anchor bolt template of the present invention that is cut from the same blank as the anchor bolt template shown in FIG. 19. The anchor bolt template shown in FIG. 22 is suitable for installations where the template is nailed to a vertical surface, such as the exterior wall of a very tall form where the concrete will not rise to the top level of the form.
Figure 23:
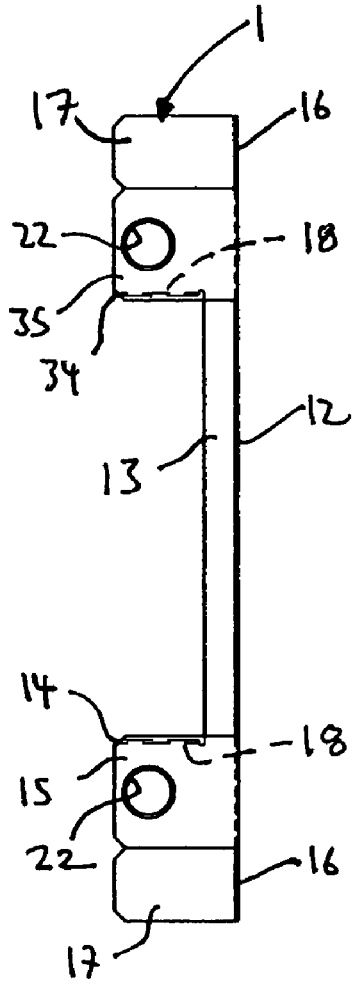
FIG. 23 is plan view of the anchor bolt template of FIG. 22 taken along lines 23-23 of FIG. 22.
Figure 24:
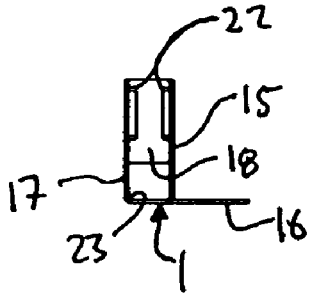
FIG. 24 is an end view of the anchor bolt template of FIG. 22 taken along lines 24-24 of FIG. 22.

For connection to a form 4 where the top surface 25 of the cementious member will not substantially approach the top surface 21 of the form 4, and the template 1 needs to be mounted to a vertical surface of the form 4, the present invention can easily be made so that the attachment flange 19 is aligned with the central elongated support 12. In this way, it is a simple matter to change progressive die form making top surface attachment templates as shown in FIGS. 1 and 7, 8 and 9 to the corresponding vertical surface attachment template shown in FIGS. 10, 11 and 12.

Figure 5:
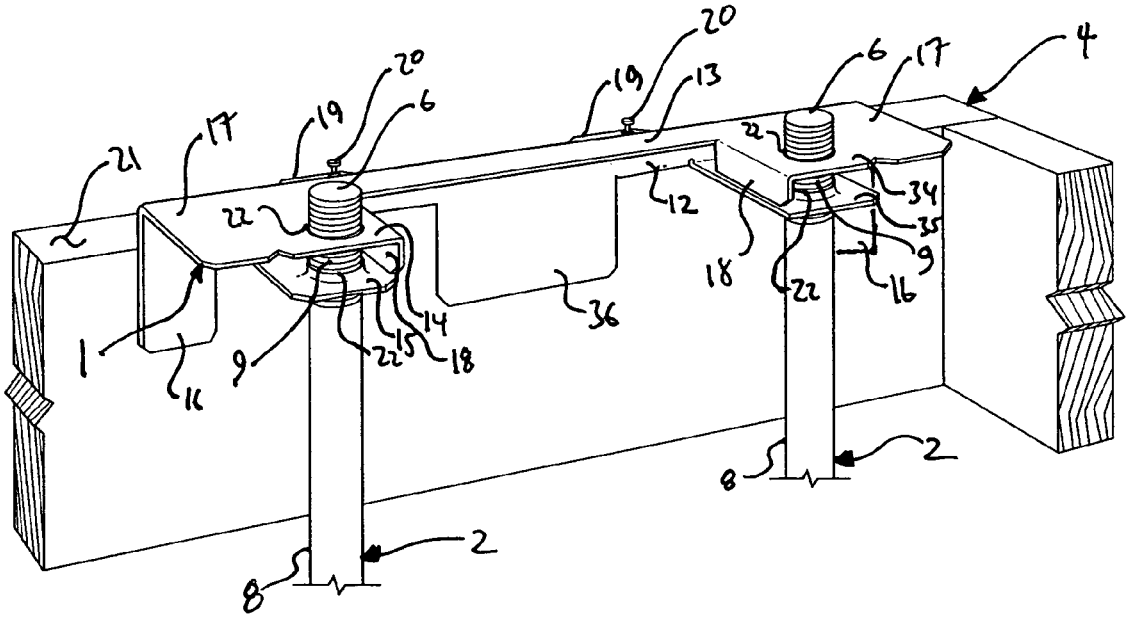
FIG. 5 is a perspective view of an anchor bolt template of the present invention attached directly to the form for the masonry foundation.

As is shown in FIGS. 1 and 5, in the preferred embodiment, the template 1 is formed with a plurality of stabilizing flanges 16 and 36 which are connected to the central elongated support 12. The plurality of stabilizing flanges 16 and 36 are substantially planar members substantially aligned with each other that rest against a vertical surface of the form 4 or support 5. Depending on the length of the template 1, the template may only be formed with a pair of stabilizing flanges 16 at each end of the template 1, as is shown in FIG. 1. If the template is longer, as is shown in FIGS. 6 and 31, the template may be made with stabilizing flanges 36 away from the ends of the template 1.

Figure 6:
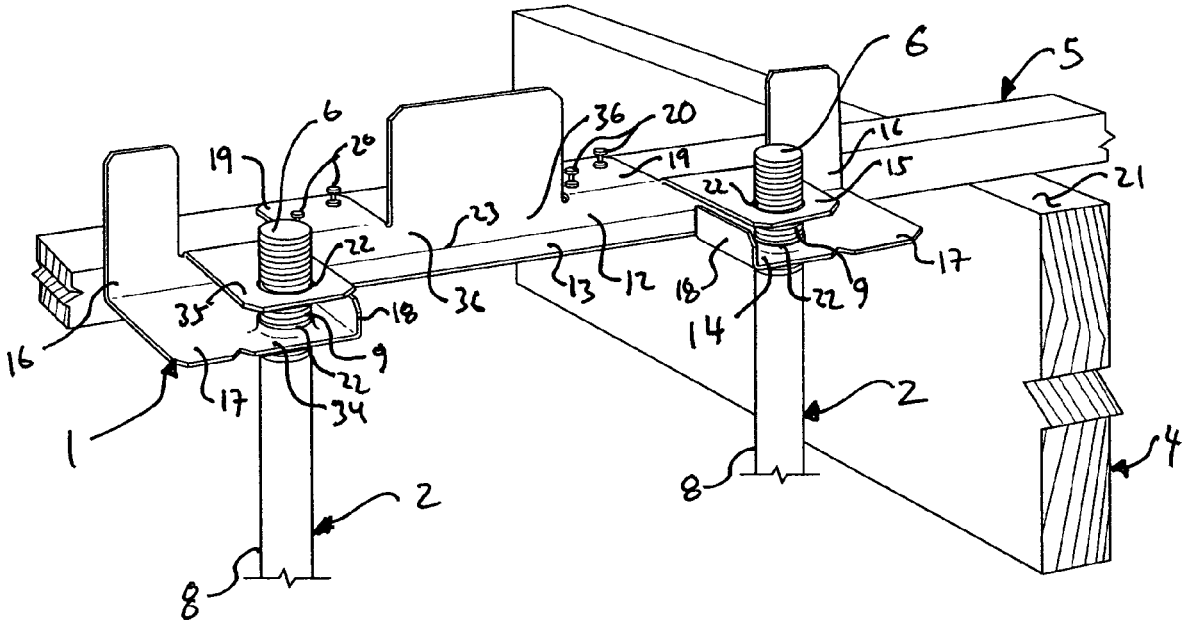
FIG. 6 is a perspective view of an anchor bolt template of the present invention attached to a support that rests on top of the form for the masonry foundation, as would typically occur if the anchor bolts were to be set within the interior of the masonry foundation.
Figure 7:
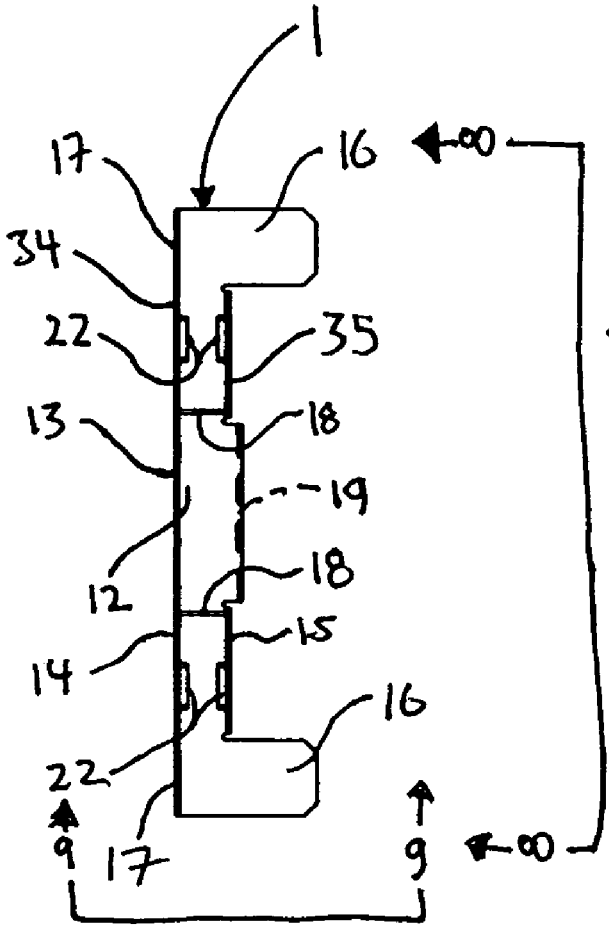
FIG. 7 is a front view of an anchor bolt template of the present invention which is also shown in FIG. 1.
Figure 8:
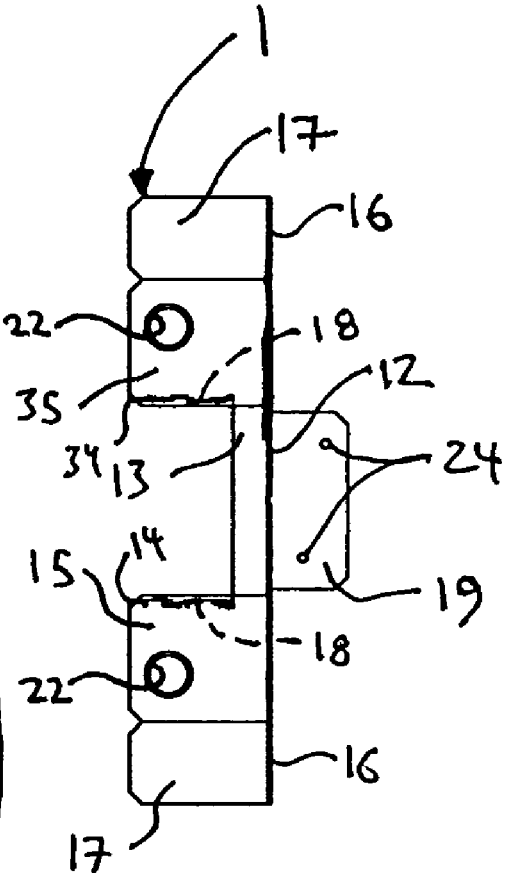
FIG. 8 is plan view of the anchor bolt template of FIG. 7 taken along lines 8-8 of FIG. 7.
Figure 9:
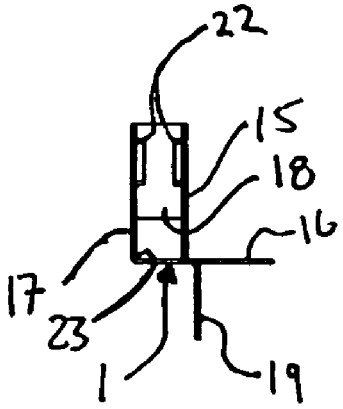
FIG. 9 is an end view of the anchor bolt template of FIG. 7 taken along lines 9-9 of FIG. 7.

As is shown in FIGS. 3 and 6, the template 1 will sometimes be suspended from a support 5 that does not define a boundary for the cementious member 3. Such applications are often called interior applications. As is shown in FIGS. 3 and 6, the additional support can be attached to the top surface 21 of the form 4; however, the additional support could be supported by any structure as is necessary.

As is shown in FIGS. 3 and 6, in the preferred form of the template 1 of the present invention, the dimensions of the template 1 are such that if a typical 2×4 or 2×6 framing member is used as the support 5 and it is laid on its wider side, such that the narrowest side, which is approximately 1.5 inches, is the side that interfaces with the stabilizing flanges 16 and 36, and the support 5 is attached to the top surface 21 of the form 4 which will substantially correspond to the top surface 25 of the cementious member, the primary anchor bolt receiving platforms 14, 34 and 44 will lie just above the top surface 25 of the cementious member 3 and not interfere with the surfacing of the cementious member 3.

As is shown in FIGS. 1 and 2, the stabilizing flanges 16 and 36 of the preferred embodiment reach far enough below the central longitudinal bend line 23, that they can stabilize the template 1 when the attachment flange is bent away from the central elongated support 12 below the central longitudinal bend line 23 as for when the template is attached to the top surface of a form board 4.

As is shown in FIG. 1, in the preferred embodiment, the central elongated support 12 has a pair of ends, and stabilizing flanges 16 are located at each end of the central elongated support 12, such that all of the primary and secondary anchor bolt receiving platforms 14, 34, 15 and 35 are located between the stabilizing flanges 16.

Also in the preferred embodiment, as is shown in FIG. 1, the attachment flange 19 is located between the stabilizing flanges 16 at the ends of the central elongated support 12, and between the attachment flange 19 and each stabilizing flange 16 at the end of the central elongated support 12 there is located a pair of primary and secondary anchor bolt receiving members 14 and 15 or 34 and 35. When the attachment flange is attached to the top surface 21 of the form, and fasteners 20 are driven into the form board 4, the fasteners 20 are offset from the line between the aligned stabilizing flanges 16, creating a triangle of bracing points for the template 1, which helps stabilize the template 1.

In the preferred embodiment, the pairs of primary and secondary anchor bolt receiving platforms 14 and 15 and 34 and 35 are located adjacent to the stabilizing flanges 16 at the ends of the central elongated support 12.

The following is a description of the embodiment of the template 1 shown in FIGS. 31, 32 and 33. Formation and dimensions of the other templates 1 are similar.

The template 1 is preferably formed from a single piece of sheet steel. The steel is preferably 14 gauge and galvanized. The sheet steel is preferably cut, punched, drawn and bent in a progressive die to create the template 1. All bend radii are preferably 1 thickness of the steel.

In the preferred form of the invention, the template 1 is preferably formed from a single blank or piece of substantially rectangular sheet metal, having a central longitudinal bend 23 which is orthogonal and extends the length of the template 1. To one side of the central longitudinal bend lie the primary anchor bolt receiving platforms 14, 34 and 44 (if present), along with the central strengthening flange 13, and the strengthening flanges 18 for the anchor bolt receiving platforms. In the preferred embodiment, the strengthening flanges are only attached to the primary anchor bolt receiving platforms 14 and 34. To the other side of the central longitudinal bend 23 lie the stabilizing flanges 16, and stabilizing flange 36, if present, the one or more attachment flanges 19, and the secondary anchor bolt receiving platforms 15, 35 and 45 (if present), all lie on the opposite side of the central longitudinal bend 23. In this fashion, the members of the template 1 can all be made without having to extend too far away from the central longitudinal bend line 23, conserving metal.

Continuing with the description of the template of FIG. 31, the template 1 of FIG. 31 is designed to be 24 inches wide. The central strengthening flange 13 and the primary anchor bolt receiving platforms 14, 34 and 44, are bent 90 degrees from the central elongated support 12 along a single central longitudinal bend line 23.

The central primary anchor bolt receiving platform 44 is 2⅝ inches wide and the primary anchor bolt receiving platforms 14 and 34 at the ends of the template 1 are 2½ inches wide. The primary anchor bolt receiving platforms 14 at the ends of the template 1 are formed with extensions 17 which are 1⅝ inches wide. The primary anchor bolt receiving platforms 14, 34 and 44 and the extensions 17 extend 2 11/16 inches from the central longitudinal bend line 23. The strengthening flange 13 extends approximately 13/16 inches from the central longitudinal bend line 23.

By having only a thin strengthening flange 13, the strengthening flange 13 does not extend as far from the central longitudinal bend line 23 as the primary anchor bolt receiving members 14 and 34, there is material for forming the strengthening flanges 18 for the primary anchor bolt receiving members 14 and 34, as shown in FIG. 32.

The strengthening flanges 18 are formed along the sides of the primary anchor bolt receiving members 14 and 34 opposite the extensions 17, by cutting the material of the blank along the edge of the strengthening flange 13 and bending the strengthening flanges 18 downwardly 90 degrees.

The primary anchor bolt receiving members 14 and 34 at the ends of the template 1 are also formed with strengthening flanges 18 on their inner sides. The strengthening flanges 18 are bent 90 degrees downwardly from the primary anchor bolt receiving platforms 14 and 34 at the ends of the template. The strengthening flanges 18 are approximately 1⅞ inches wide and extend downwardly 1 inch to the corresponding secondary anchor bolt receiving platforms 15 and 35.

The secondary anchor bolt receiving platforms 15, 35 and 45 are aligned with their corresponding primary anchor bolt receiving platforms 14, 34 and 44 and the portions of the secondary anchor bolt receiving platforms 15, 35, and 45 that receive the anchor bolts 2 are bent at a 90 degree angle from the material of the template 1 approximately 1 inch below the central longitudinal bend line 23.

The secondary anchor bolt receiving platforms 15, 35 and 45 correspond in dimension to the primary anchor bolt receiving platforms 14, 34 and 35 except that the secondary anchor bolt receiving platforms 15 and 35 at the ends of the template 1 are slightly wider so that the strengthening flanges 18 bent from the primary anchor receiving members 14 and 34 at the ends of the template 1 are able to come into contact with the secondary anchor receiving platforms 15 and 35.

The openings in the primary and second anchor receiving platforms 14 and 15, 34 and 35 and 44 and 45 are sized to receive anchors bolts 2 of a selected diameter. The centers of the anchor bolt receiving openings 22 are set approximately 2 inches from the central longitudinal bend line 23. In the particular embodiment shown in FIG. 31, the anchor bolt receiving openings 22 in the primary and secondary anchor bolt receiving platforms 14 and 15, and 34 and 44 at the ends of the template 1 are just over 1 inch in diameter and the centers of the openings 22 are spaced 2⅞ inches from the ends of the template. The openings 22 in the primary and second anchor bolt receiving platforms 44 and 45 in the center of the template 1 is just over ¾ of an inch in diameter, and the center of this opening 22 falls on a line between the centers of the openings 22 at the ends of the template 1. The diameter of the anchor bolts 2 as well as their strength, configuration and length, as well as the form and strength of the cementious member 3 is determined by the designer of the structure that will be attached to the cementious member 3 by the anchor bolts 2.

The embodiment of FIG. 31 is preferably formed with a pair of inner stabilizing flanges 36 and a pair of end stabilizing flanges 16. The inner pair of stabilizing flanges 36 are preferably 3¾ inches wide. The pair of end stabilizing flanges 16 are preferably 1½ inches wide. The stabilizing flanges 16 and 36 extend downwardly from the central longitudinal bend line 23 approximately 2 11/16 inches.

The embodiment of FIGS. 31, 32 and 33 is formed with a pair of attachment flanges 19 that are bent at a 90 degree angle from the material of the template 1 approximately 1¼ inches below the central longitudinal bend line 23. The attachment flanges 19 extend away from the central support member 12 approximately 1½ inches and are approximately 2½ inches wide. Each attachment flange 19 is formed with a pair of nail openings 24 located and spaced for driving nails 20 into a typical form board 4 which is approximately 1½ inches wide without splitting the form board 4.

Formation of the template 1 shown in FIGS. 34, 35 and 36 is similar, except that the attachment flanges are not bent 90 degrees from the material of the template 1 such that they are aligned with the stabilizing flanges 16 and 36.

We claim:

1. A connection between a holder (4, 5) and a plurality of anchor bolts (2), comprising:

a. the holder (4, 5);

b. a template (1) releasably attached to the holder (4, 5), the template (1) comprising, 1. a central elongated support (12), 2. a plurality of pairs of primary and secondary anchor bolt receiving platforms (14, 15, 34, 35, 44, 45) connected to the central elongated support (12) and having side edges disposed at an angle to the central elongated support (12), the pairs of primary and secondary anchor bolt receiving platforms (14, 15, 34, 35, 44, 45) being spaced along the central elongated support (12) from each other, each of the primary and secondary anchor bolt receiving platforms (14, 15, 34, 35, 44, 45) having a closed perimeter opening (22) therein for receiving one of the anchor bolts (2) there through, the closed perimeter openings (22) in each pair of primary and secondary anchor bolt receiving platforms (14, 15, 34, 35, 44, 45) being in alignment so as to receive the same one of the anchor bolts (2);

c. the plurality of anchor bolts (2) received by the plurality of pairs of anchor bolt receiving platforms (14, 15, 34, 44, 44, 45);

d. a plurality of fasteners (20) releasably connected to the plurality of anchor bolts (2) and supported by the template (1) to releasably attach the anchor bolts (2) to the template (1); and e. one or more strengthening flanges (18) connected to the primary anchor bolt receiving platforms (14, 34, 44), the strengthening flanges (18) being disposed at an angle to the primary and secondary anchor bolt receiving platforms (14, 15, 34, 35, 44, 45) and extending between the corresponding primary and secondary anchor bolt receiving platforms (14, 15, 34, 35, 44, 45), the strengthening flanges (18) being formed from the side edges of the primary anchor bolt receiving platforms (14, 34, 44), the strengthening flanges (18) being able to contact the secondary anchor bolt receiving platforms (15, 35 and 45) but the strengthening flanges not being directly connected to the secondary anchor bolt receiving platforms (15, 35 and 45).

2. The connection of claim 1, further comprising:

extensions (17) connected to one or more of the primary anchor bolt receiving platforms (14, 34, 44), the extensions (17) being substantially planar members (17) aligned with the primary anchor bolt receiving platforms (14, 34, 44) to which they are connected.

3. The connection of claim 1, further comprising:

a central strengthening flange (13) connected to the central elongated support (12) and disposed at an angle to the central elongated support (12) to provide the template (1) with columnar strength.

4. The connection of claim 3, wherein:

the central strengthening flange (13) is connected to and is substantially parallel with and extends between the primary anchor bolt receiving platforms (14, 34, 44).

5. The connection of claim 1, further comprising:

an attachment flange (19) connected to the central elongated support (12), the attachment flange (19) interfacing with a surface of the holder (4, 5).

6. The connection of claim 5, wherein:

the attachment flange (19) is disposed at an angle to the central elongated support (12).

7. The connection of claim 6, wherein:

the attachment flange (19) is disposed parallel to the secondary anchor bolt receiving platforms (15, 35, 45) and is designed to be attached to a top surface (21) of the holder (4, 5), and the secondary anchor bolt receiving platforms (15, 35, 45) are disposed so as to lie above both the top surface (21) of the holder (4, 5) and the attachment flange (19).

8. The connection of claim 6, wherein:

the attachment flange (19) is aligned with the central elongated support (12) for attachment to a vertically disposed surface of the holder (4, 5).

9. The connection of claim 1, wherein:

the closed perimeter openings (22) in the primary and secondary anchor bolt receiving platforms (14, 15, 34, 35, 44, 45) have curled edges to allow a smoother interface between the primary and second anchor bolt receiving platforms (14, 15, 34, 35, 44, 45) and the anchor bolt (2).

10. The connection of claim 1, further comprising:

a plurality of stabilizing flanges (16) connected to the central elongated support (12), the plurality of stabilizing flanges (16) being substantially planar members (16) substantially aligned with each other and resting against the holder (4, 5).

11. The connection of claim 10, wherein:

a. the central elongated support (12) has a pair of ends;

b. a stabilizing flange (16) of the plurality of stabilizing flanges (16) is located at each end of the central elongated support (12), such that the plurality of pairs of primary and secondary anchor bolt receiving platforms (14, 15, 34, 35, 44, 45) are located between the stabilizing flanges (16) at the ends of the central elongated support (12).

12. The connection of claim 11, further comprising:

an attachment flange (19) connected to the central elongated support (12), the attachment flange (19) substantially interfacing with a surface of the holder (4, 5).

13. The connection of claim 12, wherein:

the attachment flange (19) is located between the stabilizing flanges (16) at the ends of the central elongated support (12).

14. The connection of claim 13, wherein:

adjacent each stabilizing flange (16) at the ends of the central elongated support (12) lies one of the pairs of the primary and secondary anchor bolt receiving platforms (14, 15, 34, 35), and the attachment flange (19) is disposed between the pairs of primary and secondary anchor bolt receiving platforms (14, 15, 34, 35) disposed adjacent the stabilizing flanges (16) at the ends of the central elongated support (12).

15. The connection of claim 14, wherein:

the template (1) is formed from a blank of substantially rectangular sheet metal, having a central longitudinal bend (23) which is orthogonal and extends the length of the template (1) and the primary anchor bolt receiving platforms (14, 34, 44) lie to one side of the central longitudinal bend (23), and the stabilizing flanges (16), the attachment flange (19), and the secondary anchor bolt receiving platforms (15, 35, 45) all lie on the opposite side of the central longitudinal bend (23).

16. The connection of claim 1, further comprising:

a plurality of stabilizing flanges (16) connected to the central elongated support (12), the plurality of stabilizing flanges (16) being substantially planar members substantially aligned with each other and resting against the holder (4,5).

17. The connection of claim 16, wherein:

a. the central elongated support (12) has a pair of ends;

b. a stabilizing flange (16) of the plurality of stabilizing flanges (16) is located at each end of the central elongated support (12), such that the plurality of pairs of primary and secondary anchor bolt receiving platforms (14, 15, 34, 35, 44, 45) are located between the stabilizing flanges (16) at the ends of the central elongated support (12).

18. The connection of claim 17, further comprising:

an attachment flange (19) connected to the central elongated support (12), the attachment flange (19) substantially interfacing with a surface of the holder (4,5), and the attachment flange (19) is located between the stabilizing flanges (16) at the ends of the central elongated support (12).

19. The connection of claim 18, wherein:

adjacent each stabilizing flange (16) at the ends of the central elongated support (12) lies one of the pairs of the primary and secondary anchor bolt receiving platforms (14, 15, 34, 35), and the attachment flange (19) is disposed between the pairs of primary and secondary anchor bolt receiving platforms (14, 15, 34, 35) disposed adjacent the stabilizing flanges at the ends of the central elongated support.

20. The connection of claim 19, wherein:

the template (1) is formed from a blank of substantially rectangular sheet metal, having a central longitudinal bend (23) which is orthogonal and extends the length of the template (1) and the primary anchor bolt receiving platforms (14, 34, 44) lie to one side of the central longitudinal bend (23), and the stabilizing flanges (16), the attachment flange (19), and the secondary anchor bolt receiving platforms (15, 35, 45) all lie on the opposite side of the central longitudinal bend (23).

* * * * *